United States Patent [19]

Watanabe

[11] Patent Number: 4,763,166

[45] Date of Patent: Aug. 9, 1988

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 910,665

[22] Filed: Sep. 23, 1986

[30] Foreign Application Priority Data

Sep. 27, 1985 [JP] Japan ..... 60-212530
Nov. 22, 1985 [JP] Japan ..... 60-263021

[51] Int. Cl.[4] ..... G03G 15/00

[52] U.S. Cl. ..... 355/14 SH; 355/3 SH; 355/3 TR; 355/14 TR

[58] Field of Search ..... 355/3 TR, 3 CH, 14 TR, 355/14 R, 14 SH, 23, 24; 271/171, 310, 311, 300, 303, 312, 900

[56] References Cited

U.S. PATENT DOCUMENTS

| | | | |
|---|---|---|---|
| 3,950,680 | 4/1976 | Michaels et al. | 355/14 CH X |
| 4,000,942 | 1/1977 | Ito et al. | 355/3 TR |
| 4,306,800 | 12/1981 | Kopp | 355/3 TR |
| 4,341,457 | 7/1982 | Nakahata et al. | 355/3 TR |
| 4,343,036 | 8/1982 | Shimizu et al. | 364/518 |
| 4,370,048 | 1/1983 | Shibuya et al. | 355/3 TR |
| 4,401,382 | 6/1983 | Minejima et al. | 271/900 X |
| 4,417,800 | 11/1983 | Hirose et al. | 355/3 TR |
| 4,487,506 | 12/1984 | Repp et al. | 355/24 X |
| 4,501,490 | 2/1985 | Miyamoto et al. | 355/14 R |
| 4,540,275 | 9/1985 | Iwahashi | 355/3 CH |
| 4,572,648 | 2/1986 | Toriumi et al. | 355/14 SH |
| 4,585,336 | 4/1986 | Tanaka | 355/3 SH |

FOREIGN PATENT DOCUMENTS

| | | | |
|---|---|---|---|
| 2852060 | 6/1979 | Fed. Rep. of Germany . | |
| 2903265 | 7/1980 | Fed. Rep. of Germany . | |
| 194072 | 11/1983 | Japan | 355/14 TR |
| 193568 | 11/1983 | Japan | 355/14 TR |
| 212331 | 12/1984 | Japan | 271/171 |
| 169872 | 9/1985 | Japan | 355/3 TR |

*Primary Examiner*—Arthur T. Grimley
*Assistant Examiner*—Ed Pipala
*Attorney, Agent, or Firm*—Foley & Lardner, Schwartz, Jeffery, Schwaab, Mack, Blumenthal & Evans

[57] ABSTRACT

An electronic copying machine for copying an image on a document, onto a sheet, includes a deelectrifier for electrically peeling off a sheet, on which a toner image has been formed, from a photosensitive drum, and a peel-off tape which is engaged with a sheet, to mechanically peel it from the photosensitive drum. After a copying operation, a sheet is stacked in a stacking tray which is selectively moved to a position at which it is engaged with or not engaged with the peel-off tape. During a second copying operation, after a position-setting operation is performed in the stacking tray, the sheet is conveyed to a transfer position of the photosensitive drum. After the second transfer operation, the sheet is selectively peeled off by the peel-off tape, in accordance with the position preset by the stacking tray.

42 Claims, 25 Drawing Sheets

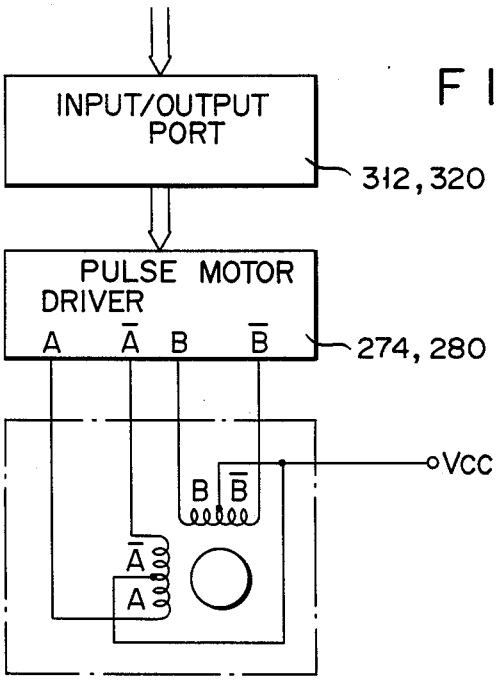
FIG. 23
FIG. 24
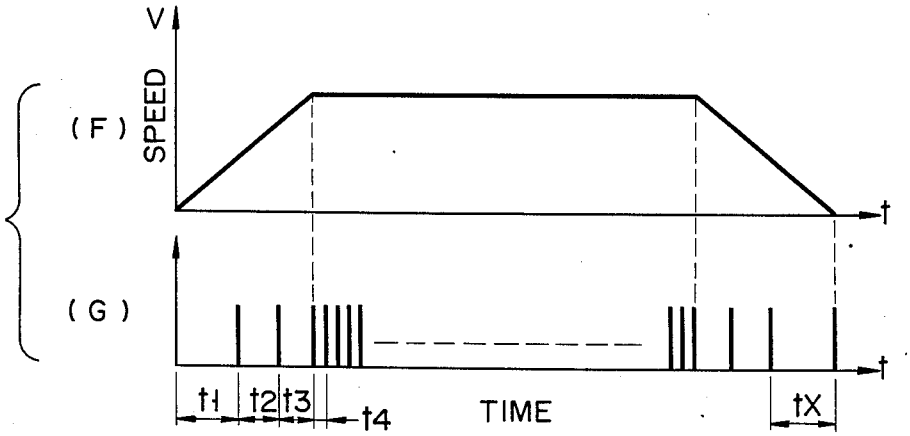

IMAGE FORMING APPARATUS

BACKGROUND OF THE INVENTION

The present invention relates to an image forming apparatus for copying an image on a document onto a sheet.

In an electronic copying machine of this type, a document is exposed and light reflected thereby is radiated onto a photosensitive drum, to form an electrostatic latent image thereon. Toner is attached to the latent image on the photosensitive drum, to form a toner image which is then transferred onto a sheet. Then, the sheet is peeled from the photosensitive drum, and toner is fixed to the sheet.

When a toner image formed on the photosensitive drum is transferred to a sheet, the sheet is attracted to the peripheral surface of the drum by an electrostatic force. Therefore, when the sheet is peeled from the peripheral surface of the drum, the electrostatic force on the peripheral surface of the drum is removed by a deelectrifying lamp. Then, the sheet is separated from the peripheral surface of the drum due to the inherent stiffness of the sheet (i.e., the force by which a bent sheet returns to the straight state). Toner is heated and melted to be fixed to the sheet.

In recent years, a multiple-copying technique is known, for forming a color image by repeating the above-mentioned copying operation for a single sheet.

In addition, a double-side copying technique is known, wherein after an image on a document is formed on one surface of a sheet, an image on another document is formed on the other surface of the sheet.

In such a multiple-copying or double-side copying technique, after a sheet is fed to a photosensitive drum and a toner image is formed on the sheet, the sheet is again fed to the photosensitive drum, to form a plurality of toner images thereon.

However, once a copying image is formed on a sheet, the stiffness of it is decreased since it is heated during the toner-fixing process, and, as a result, the sheet is often curled or bent.

When the curled sheet is again fed to the photosensitive drum, to form another image thereon, due to the toner-fixing process and the sheet's consequent decreased stiffness, the sheet must now be peeled off the peripheral surface of the drum. However, because the electrostatic force is removed only by the deelectrifying lamp, due to its reduced stiffness, the sheet cannot be reliably peeled off the peripheral surface of the drum. Because of this, paper jamming is likely to occur.

For this reason, another copying machine has been developed, in which a tape is interposed, in advance, between the sheet and the drum, and the sheet is mechanically peeled by off means of the tape.

However, when the tape is interposed between the drum and the sheet, toner cannot be transferred to that portion of the sheet facing the tape. Therefore, when a tape is used, the image-forming area of a sheet is decreased.

SUMMARY OF THE INVENTION

It is an object of the present invention to provide an image forming apparatus which can prevent a sheet from jamming and which can increase the image-forming area of a sheet when a multiple-copying or double-side copying operation is performed.

According to an aspect of the present invention, there is provided an image forming apparatus for forming an image on a document, on a sheet, comprising an image carrier; image forming means for forming an electrostatic image corresponding to an image on a document on the image carrier; transfer means which causes the sheet to be in contact with said image carrier, to transfer the latent image formed on said image carrier onto the sheet; first peel-off means for electrically peeling the sheet off the image carrier, after the transfer operation, second peel-off means which is engaged with the sheet to mechanically peel the sheet off the image carrier, after the transfer operation; and sheet position-control means for selectively moving the sheet or said second peel-off means to a first position at which the sheet is engaged with said second peel-off means, or to a second position at which the sheet is not engaged with said second peel-off means.

BRIEF DESCRIPTION OF THE DRAWINGS

FIG. 23 is a schematic diagram showing a control circuit for pulse motors shown in FIG. 19;

FIG. 24 is a graph for explaining a speed control method of the pulse motors;

DETAILED DESCRIPTION OF THE PREFERRED EMBODIMENTS

An embodiment of the present invention will be described in detail hereinafter with reference to FIGS. 1 to 29.

Figure 1:
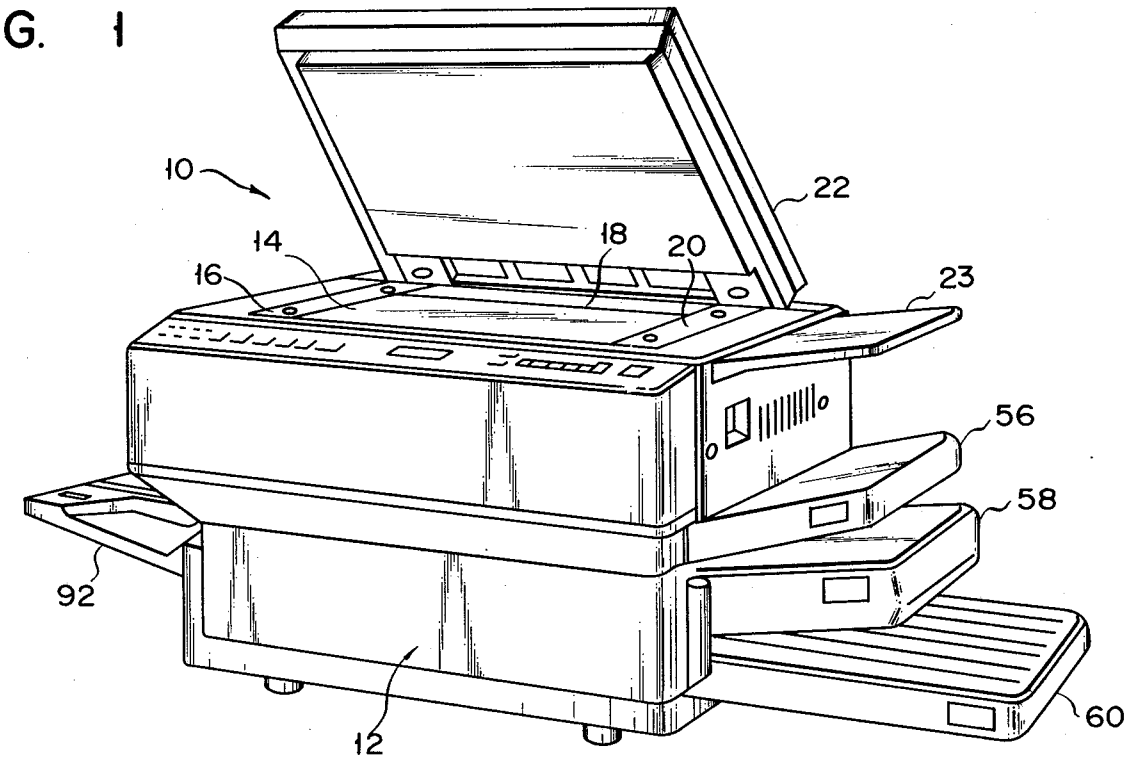
FIG. 1 is a perspective view of an electronic copying machine according to an embodiment of the present invention.
Figure 2:
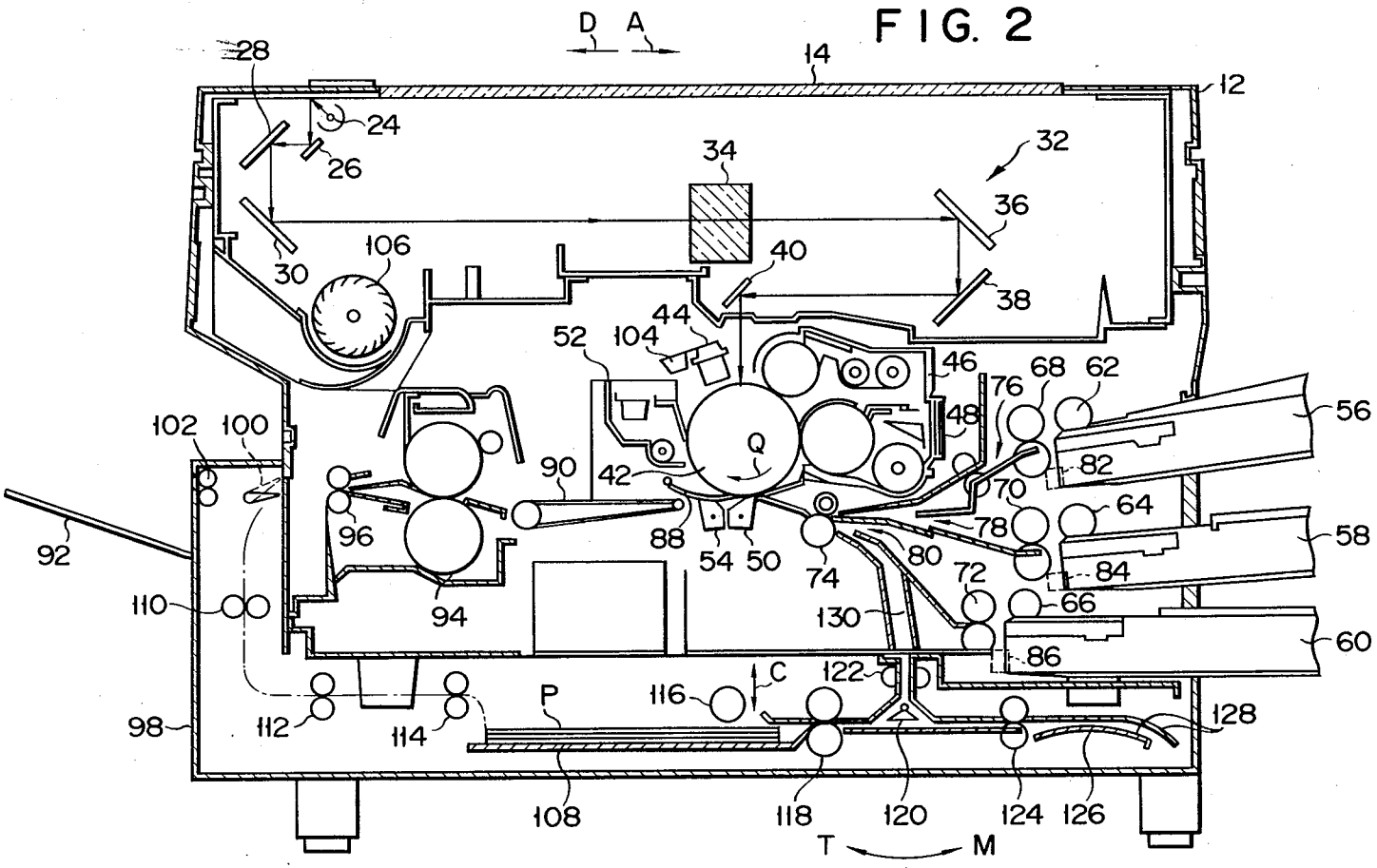
FIG. 2 is a schematic longitudinal sectional view of the copying machine shown in FIG. 1.

As is shown in FIGS. 1 and 2, document table (14 made of transparent glass) for supporting a document, is fixed to the upper portion of housing 12 of electronic copying machine 10. First, second, and third stationary scales 16, 18, and 20 on which reference positions for a document to be placed on the document table are printed, are fixed to the edge portions of table 14 along its widthwise and longitudinal directions, respectively. The reference positions are printed on first and second scales 16 and 18, with reference to the corners of table 14, and are printed on third scale 20 so that a sheet is placed in substantially the central portion thereof. Document cover 22 for pressing a document placed on table 14, and work table 23, are arranged on the upper portion of housing 12.

Exposure unit 32 consisting of exposure lamp 24 and mirrors 26, 28, and 30, is arranged below document table 14, to be freely reciprocated in the direction indicated by arrows A and $\theta$ along the lower surface of table 14. Upon reciprocal movement of unit 32, a document is exposed. In this case, mirrors 28 and 30 are moved at a speed half that of mirror 26, to keep their optical path lengths. Light reflected by a document upon scanning of exposure unit 32, i.e., light reflected by the document upon light radiation of exposure lamp 24, is reflected by mirrors 26, 28, and 30, and then passes through magnification-changing lens block 34. Then, the light is reflected by mirrors 36, 38, and 40, and is guided onto photosensitive drum 42, to form an image on the document, on the surface of drum 42.

Photosensitive drum 42 is arranged at substantially the center of housing 12, to be rotatable in the direction indicated by arrow B. In the vicinity of drum 42, charger 44 for charging the surface of drum 42, developers 46 and 48 for spreading toner on a latent image, transfer device 50 for transferring a toner image on the surface of drum 42 onto a sheet, and cleaning device 52 for removing residual toner on drum 42, are arranged in this order along rotation direction B. Deelectrifier 54 for electrostatically peeling a sheet off drum 42 is arranged between transfer device 50 and cleaning device 52.

When drum 42 is rotated in the direction indicated by arrow B, its surface is first charged by charger 44, and is moved in the direction of arrow B, so that an image is slit-exposed thereon, to form a latent image. Toner becomes attached to the latent image by means of developers 46 and 48 which store, for example, red and black toners, and which are selectively driven as required, thereby forming the latent image.

First to third sheet-feed cassettes 56, 58, and 60, which store sheets on which an image is to be formed, are mounted on the side portion of housing 12. The respective cassettes store sheets of different sizes; that is, first cassette 56 stores A4-size sheets, second cassette 58 stores B5-size sheets, and third cassette 60 stores B4-size sheets. Pickup rollers 62, 64, and 66 for picking up sheets from the cassettes, and pairs of feed rollers 68, 70, and 72, for feeding the picked-up sheets, are arranged at the mounting portions of the respective cassettes, respectively, so that sheets are selectively picked up, one by one, from cassettes 56, 58, and 60. A sheet picked up from cassette 56 is fed by a pair of feed rollers 68, and is conveyed to register roller pair 74 via first guide 76. Similarly, sheets picked up from cassettes 58 and 60 are conveyed to register roller pair 74 respectively via second and third guides 78 and 80. Register roller pair 74 aligns the distal end of a sheet conveyed thereto, and conveys it to transfer device 50, in synchronism with the rotation of drum 42. Cassette size-detection switches 82, 84, and 86 are arranged in housing 12, at the mounting portions of cassettes 56, 58, and 60, to detect the sizes of mounted cassettes. Switches 82, 84, and 86 comprise a plurality of microswitches which are turned on or off in accordance with the insertion of cassettes of different sizes.

Sheet P, conveyed to toner image-transfer device 50, is brought into contact with the surface of drum 42 by means of a transfer charger of transfer device 50, and the toner image on the surface of drum 42 is transferred onto sheet P thereby. Sheet P, onto which the toner image is transferred, is electrostatically peeled off drum 42 by deelectrifier 54 or is forcibly peeled off by tape 88. Tape 88 is formed of a plastic material, for example, a Mylar material, and is interposed between transfer device 50 and deelectrifier 54, and drum 42, and extends to one side along the conveying path of a sheet, in correspondence with the edge portion of a sheet. A sheet peeling operation by way of tape 88 will be described later.

A sheet peeled off drum 42 is conveyed by conveyor belt 90 toward tray 92 of housing 12. A pair of fixing rollers 94 for melting and fixing toner transferred onto a sheet, are arranged between conveyor belt 90 and tray 92. A pair of conveyor rollers 96 for conveying a sheet, selector 100 for selectively guiding a sheet to tray 92 or to sheet re-feed unit 98 (to be described later), and a pair of exhaust rollers 102, are arranged between fixing rollers 94 and tray 92 in the order mentioned. Therefore, toner is fixed onto a sheet after the transfer operation, and the sheet is then conveyed to tray 92 or to unit 98.

Toner remaining on drum 42 after the transfer operation, is removed by cleaning device 52, and an after-image is erased by deelectrifying lamp 104, thereby returning drum 42 to the initial state. Note that reference numeral 106 denotes a cooling fan for preventing an increase in temperature in housing 12.

Sheet re-feed unit 98 described above will now be explained below.

Re-feed unit 98 conveys a sheet which has been subjected to copying toward transfer device 50, in order to perform a double-side, or multiple-copying operation on a single sheet. Unit 98 includes stacking tray 108 for stacking sheets P guided by guide 100, and a plurality of roller pairs 110, 112, and 114 for guiding a sheet to tray 108, arranged in this order, in addition to selector 100 and exhaust roller pair 102 described above. Pickup roller 116, for picking up sheets P temporarily stored in tray 108, is arranged at tray 108. Roller 116 is vertically movable in accordance with the thickness (the number) of sheets P stored in tray 108, as indicated by arrow C. Sheet P, picked up by roller 116, is guided to control gate 120 via separating roller pair 118 for separating picked-up sheets one by one. Control gate 120 is swingable. When a multiple-copying operation is performed, control gate 120 is pivoted in the direction of arrow M in FIG. 2, so as to guide sheet P toward register roller pair 74 via convey roller pairs 122 and sheet guide path 124. In this way, sheet P, after copying, is conveyed toward drum 42, so that a new image overlaps an already copied image.

When a double-side copying operation is performed, i.e., when an image is formed on the back surface of a copied image of sheet P after copying, sheet P must be conveyed, so that its back surface of the copied surface faces drum 42.

In this case, sheet P is guided to reverse unit 126 via conveyor roller pair 124. Reverse unit 126 consists of a pair of guide plates 128, between which a sheet is temporarily stored, so as to change the feed-side distal end of the sheet. More specifically, when sheet P is stored in reverse unit 126, control gate 120 is pivoted in the direction of arrow T, so that sheet P, fed by conveyor roller pair 124, is guided toward registor roller pair 74 via conveyor roller pair 122 and sheet guide path 130. In this embodiment, control gate 120 is normally biased in the direction of arrow M, i.e., it is set in the multiple-copying mode.

The arrangement of stacking tray 108 will now, be described with reference to FIGS. 3 to 6.

Stacking tray 108 consists of bottom plate 132 on which sheet P is placed, front plate 134 which is inclined in the pickup direction of sheet P, and a pair of first and second side plates 136 and 138 which oppose each other. First and second side plates 136 and 138 can slide in opposite directions along bottom plate 132 (in the directions of arrows D). First side plate 136 is coupled to rack **140*a*, which is meshed with pinion 144*a* of motor 142*a*. Similarly, second side plate 138 is provided with rack 140*b*, motor 142*b*, and pinion 144*b*. With this arrangement of tray 108, since side plates 136 and 138 are freely slidable along bottom plate 132, the storing position of sheets P in tray 108** can be selected to be at the center or at one side.

Figure 3:
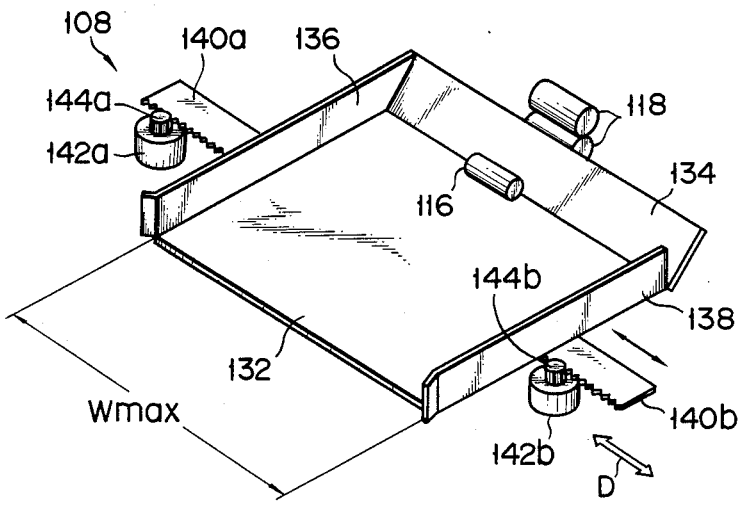
FIG. 3 is a perspective view showing a stacking unit.
Figure 4:
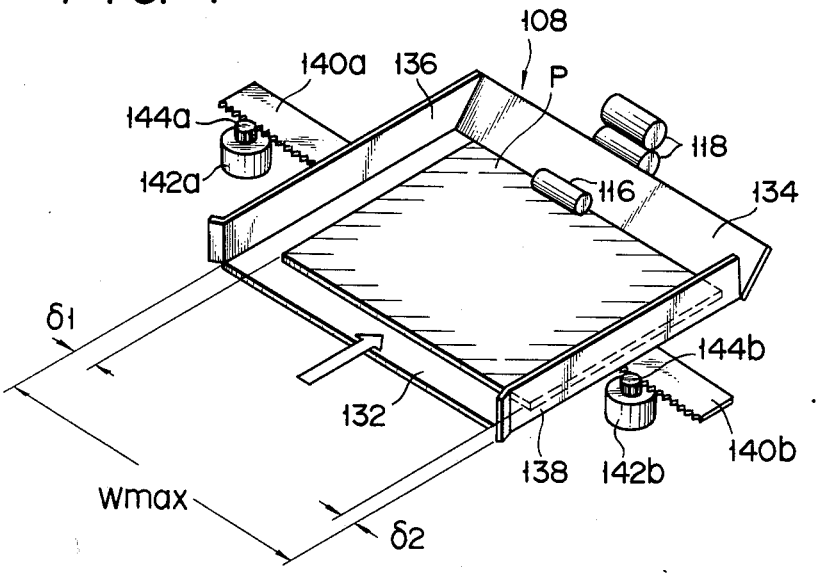
FIGS. 4 to 6 are views for explaining the guide operation of a sheet in the stacking unit.
Figure 5:
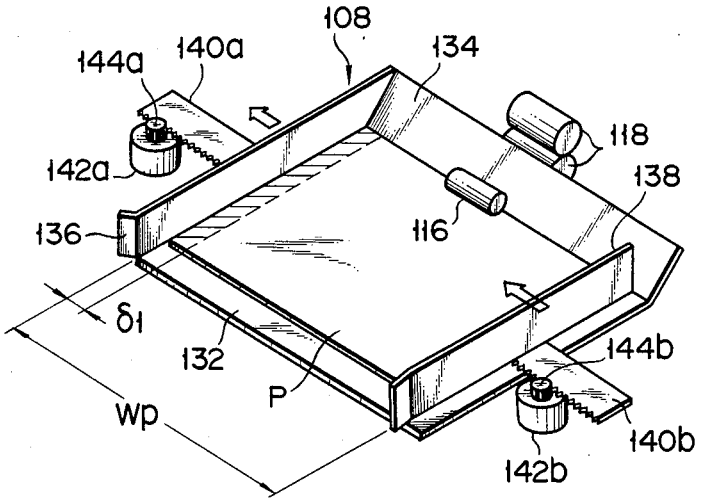
Figure 6:
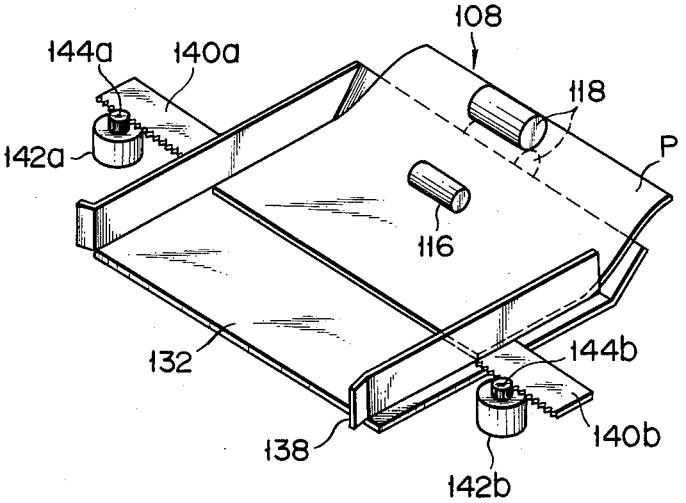

Note that as shown in FIG. 3, the distance between first and second side plates 136 and 138, in other words, width W of tray 108, can be increased up to Wmax. When width W is Wmax, if sheet P is fed to tray 108, gap $\delta_1$ is formed between one end portion of sheet P and side plate 136, and gap $\delta_2$ is formed between the other end portion of sheet P and side plate 138. When sheet P is stored in tray 108, motor **142*b* is rotated to move second side plate 138, and sheet P is moved to first side plate 136 by distance ($\delta 1+\delta 2$), as shown in FIG. 5. In this case, the width of sheet P is Wp. Thereafter, second side plate 138 is returned to its original position upon rotation of motor 142*b*. Reciprocal movement of side plate 138 is repeated each time sheet P is fed to tray 108. Sheet P, moved as described above, is picked up by pickup roller 116, as shown in FIG. 6, is conveyed to control gate 120 by separating roller pair 118, and is then guided to drum 42, with or without being reversed, via unit 126**.

Figure 27:
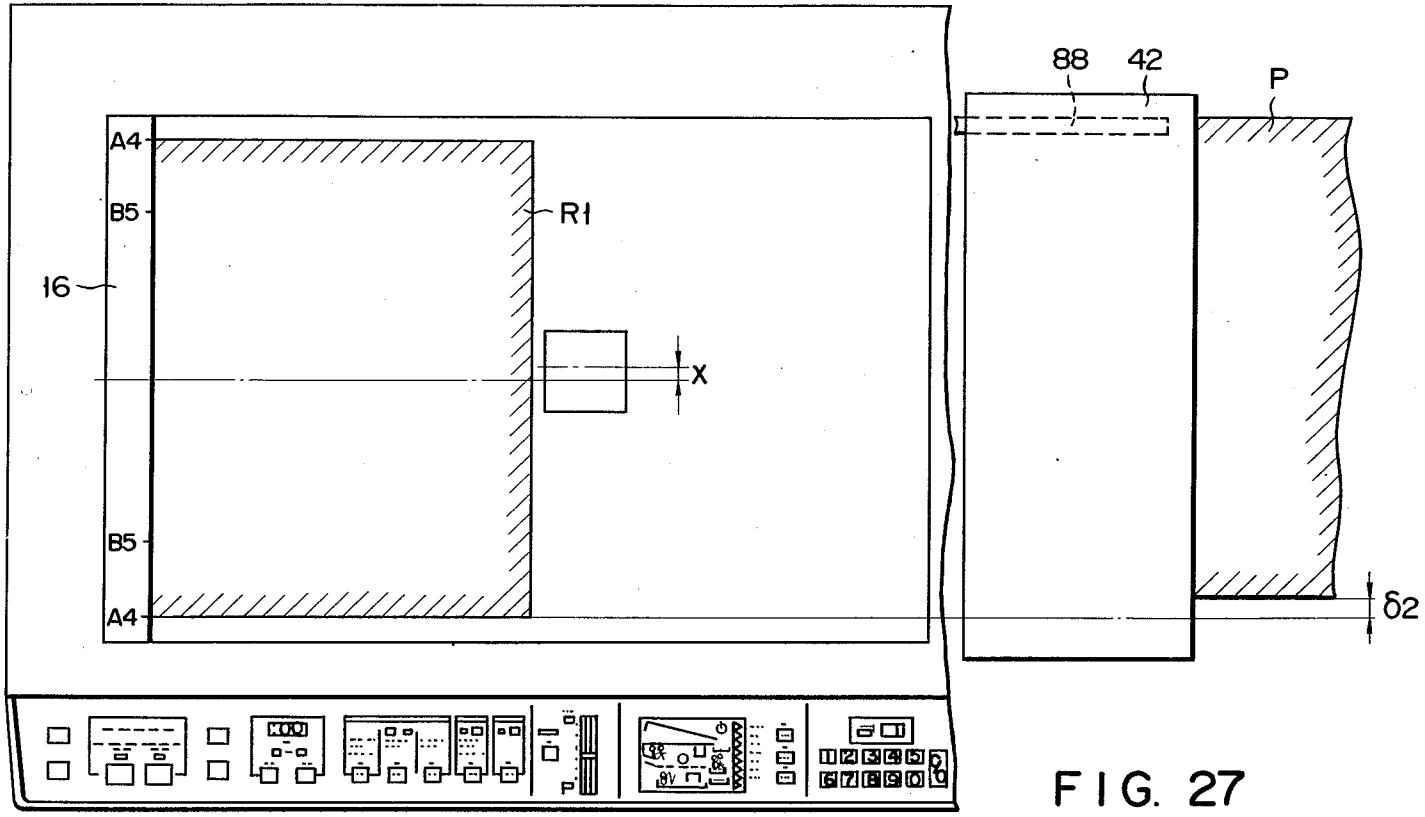

In stacking tray 108, when sheets P are stacked, sheet P is moved in its widthwise direction (in the direction perpendicular to the conveying direction) to a position at which sheet P can be engaged with tape 88 (shown in FIG. 27). The positional relationship between tape 88 and sheet P will be described later in detail.

During a copying operation for a second or subsequent time, if tape 88 is not used, first side plate 136 is moved inward by distance $\delta 1$ and second side plate 138 is moved inward by distance $\delta 2$, so that sheet P is located at substantially the center of bottom plate 132. With this operation, sheet P can be placed at a position at which it is not engaged with tape 88 during a toner transfer process.

Figure 7:
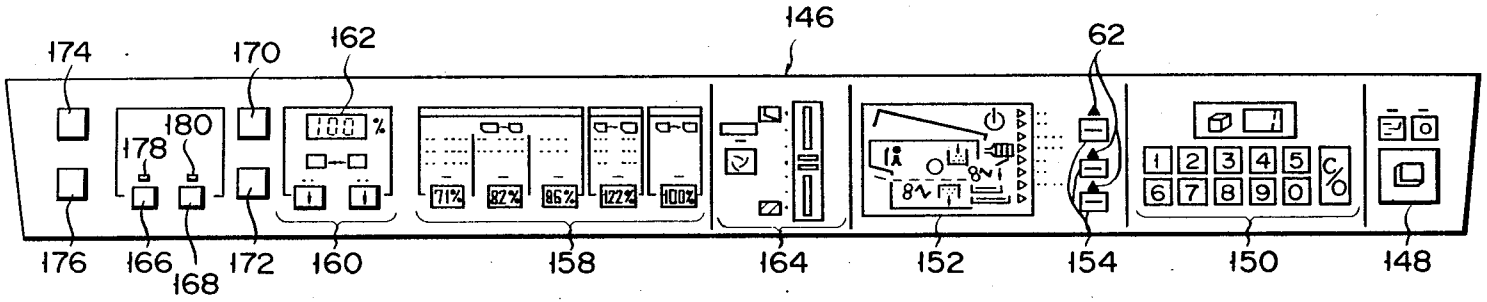
FIG. 7 is a plan view of a control panel of the copying machine shown in FIG. 1.

FIG. 7 is a plan view of a control panel arranged on housing 12. Referring to FIG. 7, reference numeral 148 denotes a copy key for starting the copying operation; 150, ten keys for setting the copying number and the like; 152, a display unit for displaying the operation states of respective units, jam of sheet P, and the like; 154, cassette selection keys for selecting upper, middle, and lower cassettes 56, 58, and 60; 156, cassette indicators for indicating a selected cassette; 158, magnification-setting keys for setting enlargement and reduction magnifications to achieve predetermined size relationships; 160, zoom keys for continuously varying the enlargement and reduction magnifications; 162, a display unit for displaying a set magnification; and 164, a density-setting section for setting the copying density. Reference numeral 166 denotes a multiple-copying key; 168, a doubleside copying key; 170, a "black" key for designating developer 48; 172, a "red" key for designating developer 46; 174, a peel-off tape key for designating the peeling operation by way of tape 88; and 176, a peel-off tape cancel key for canceling the peeling operation by way of tape 88. In addition, reference numerals 178 and 180 denote lamps indicating inputting via the corresponding keys.

Figure 8:
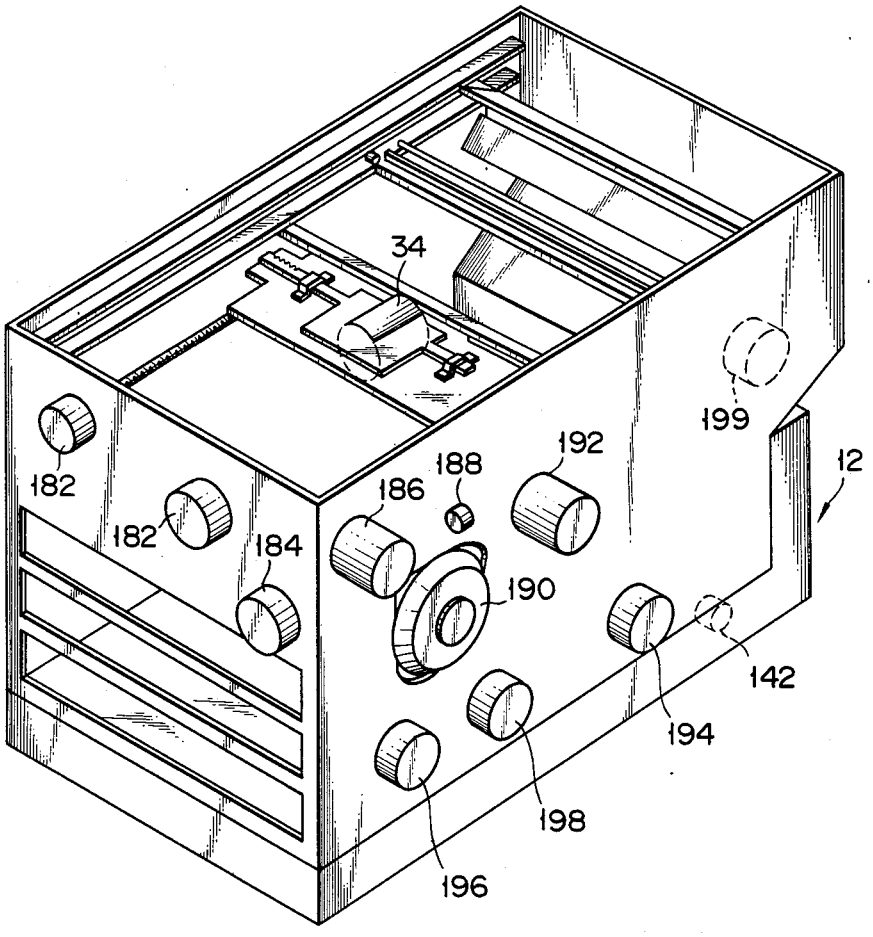
FIG. 8 is a schematic perspective view of a driving unit of the copying machine shown in FIG. 1.

FIG. 8 shows the arrangement of drive sources for respective driving sections of the copying machine with the above arrangement. Reference numeral 182 denotes a motor for driving lens block 34, which changes the magnification factor; 184, a mirror motor for changing the distances (optical path lengths) between mirror 26 and mirrors 28 and 30; 186, a scanning motor which moves lamp 24 and mirrors 26, 28, and 30 for scanning a document; 188, a shutter motor for moving a shutter (nc. shown) which adjusts the charging width on drum 42, by charger 44; 190, the developing motor for driving the developing roller of developer 46, and the like; 192, a drum motor for driving drum 42; 194, a fixing motor for driving conveyor belt 90, fixing roller pair 94, and exhaust roller pair 96; 196, a sheet-supply motor for driving pickup rollers 62, 64, and 66; 198, a sheet-feed motor for driving register roller pair 74; and 199, a fan motor for driving cooling fan 106.

Figure 9:
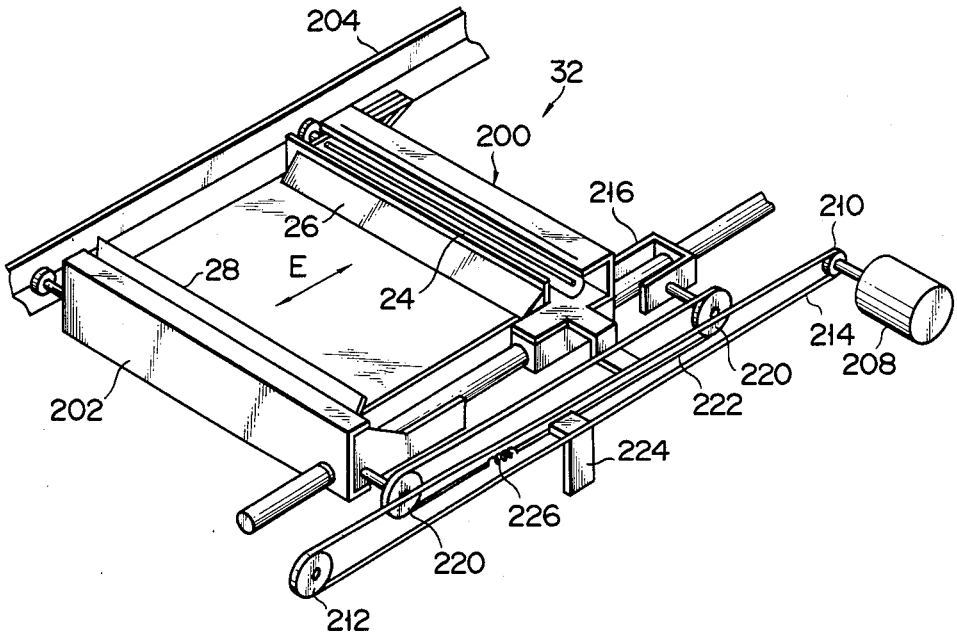
FIG. 9 is a perspective view of an exposure unit.

FIG. 9 shows a driving mechanism for reciprocating exposure unit 32. Mirror 26 and exposure lamp 24 are supported on first carriage 200, and mirrors 28 and 30 are supported on second carriage 202. Carriages 200 and 202 are guided along guide rails 204 and 206, to be movable parallel to each other in the direction of arrow E. More specifically, four-phase pulse motor 208 drives pulley 210. Endless belt 214 is looped between pulley 210 and idle pulley 212, and one end of first carriage 200 for supporting mirror 26 is fixed midway along belt 214. Two pulleys 220 are rotatably arranged on guide portion 216 of second carriage 202 for supporting mirrors 28 and 30 to be separated in the axial direction of rod-like rail 218. Wire 222 is looped between pulleys 220. One end of wire 222 is fixed to fixing portion 224, and the other end thereof is fixed thereto by means of coil spring 226. One end of first carriage 200 is fixed midway along wire 222. Therefore, upon rotation of pulse motor 208, belt 214 is rotated to move first carriage 200, and upon this movement, second carriage 202 is also moved. At this time, since pulleys 220 serve as running blocks, second carriage 202 is moved at a speed half that of first carriage 200, in the same direction. Note that the moving direction of carriages 200 and 202 is controlled by switching the rotating direction of pulse motor 208.

First carriage 200 is moved to a predetermined position (a home position corresponding to a set magnification factor) when motor 208 is driven in accordance with the sheet size and the magnification factor to be used. When copy key 148 is depressed, first carriage 200 is first moved toward second carriage 202, thereafter, lamp 24 is turned on, and carriage 200 is then moved to be separated from carriage 202. After document scanning is completed, lamp 24 is turned off, and carriage 200 is returned to the home position.

Figure 10:
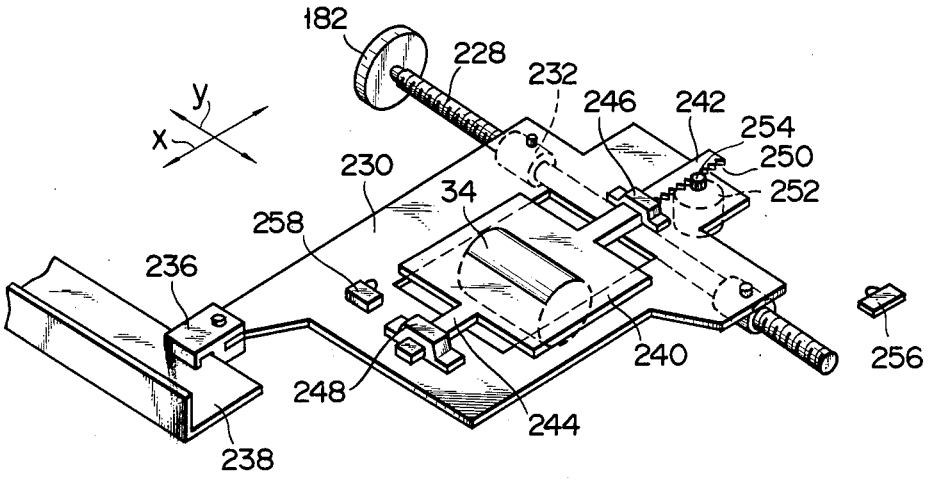
FIG. 10 is a perspective view of a lens unit.

FIG. 10 shows the driving mechanism of lens block 34. Motor 182 rotates lead screw 228 extending along the directions of movement (y directions) of first carriage 200. Bushes 232 and 234, provided at one end portion of base 230, are screwed around lead screw 228. When screw 228 is rotated, base 230 is moved in the y directions. Guide member 236 is arranged at the other end portion of base 230 and is slidably engaged with guide rail 238. In addition, moving member 240, which is movable in directions (x directions) perpendicular to the directions of movement of base 230 and on which lens block 34 is mounted, is arranged on base 230. More specifically, support members 242 and 244 are arranged at two end portions of moving member 240 and are guided and held by guide members 246 and 248 formed on base 230. Rack 250 is formed in the side surface portion of support member 242 along its longitudinal direction and is meshed with pinion 254 rotated by pulse motor 252 arranged on base 230. Therefore, lens block 34 is moved in the x directions upon rotation of motor 252. Note that microswitches 256 and 258 detect the initial positions of base 230 and moving member 240, respectively.

The relationship between the operation of lens block 34 and an image formed will now be described with reference to FIGS. 11 and 12.

Figure 11:
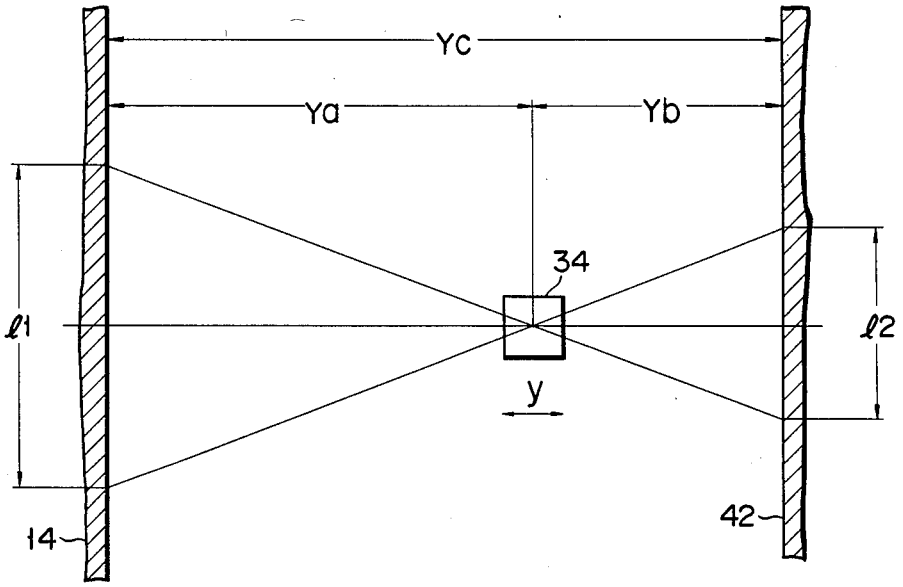
FIGS. 11 and 12 are views for explaining the relationship between the operation of the lens unit and an image formed on the peripheral surface of a photosensitive drum.

Referring to FIG. 11, the focal length of lens block 34 is given by f, the optical path length from document table 14 to lens block 34 is given by $Y_a$, the optical path length from lens block 34 to drum 42 is given by $Y_b$, and the total optical path length from document table 14 to drum 42 is given by $Y_c$, the optical formula can be expressed by:

$$1/f=1/Y_a+1/Y_b$$

Magnification factor K can be expressed by:

$$K=Y_b/Y_a$$

Since focal length f of lens block 34 is constant, optical path lengths Ya and Yb must be changed, as well as total optical path length Yc, in order to adjust the focal point when the magnification factor is changed. Lengths Ya and Yb can be changed by moving lens block 34 in the y directions. The total optical path length Yc can be changed by moving second carriage 202, to shift mirrors 28 and 30.

Figure 12:
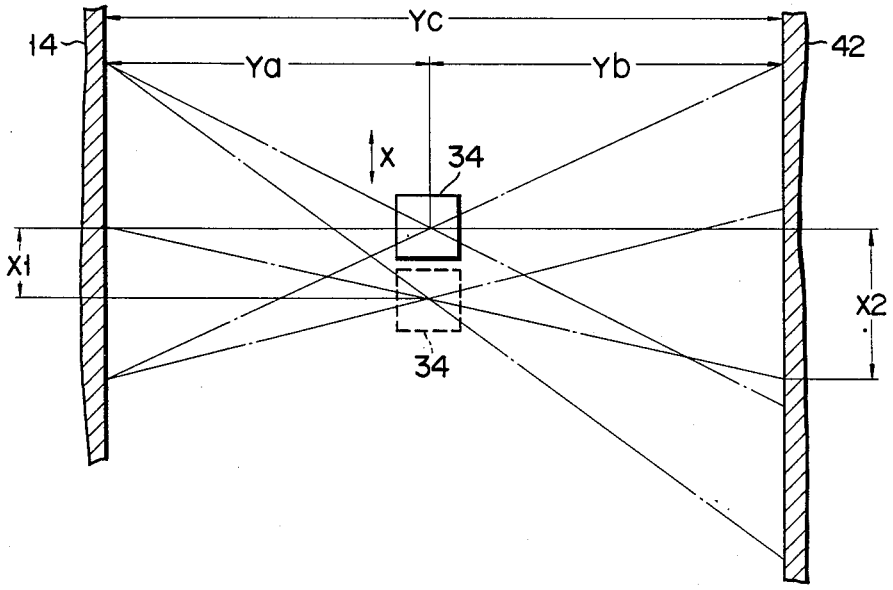

As is shown in FIG. 12, if the distances between table 14, lens block 34, and drum 42 are constant, and if lens block 34 is moved in the X directions by motor 252, by distance $X_1$, an image on drum 42 is moved by distance $X_2$, which is expressed by the following relation:

$$X_2=X_1\times Yb/Ya$$

In the case of an equal magnification factor, x2 can be expressed by:

$$X_2=2(X_1)$$

In this manner, the center of a copied image can be moved upon movement of lens block 34 in the x directions.

In the above state, if a copying operation for a second document in a multiple-copying or double-side copying mode is to be performed, lens block 34 is moved in the x and y directions in accordance with the copying magnification factor set by key 158, the sheet size selected by key 154, and the distance of movement δ of sheet P in tray 108.

Figure 13:
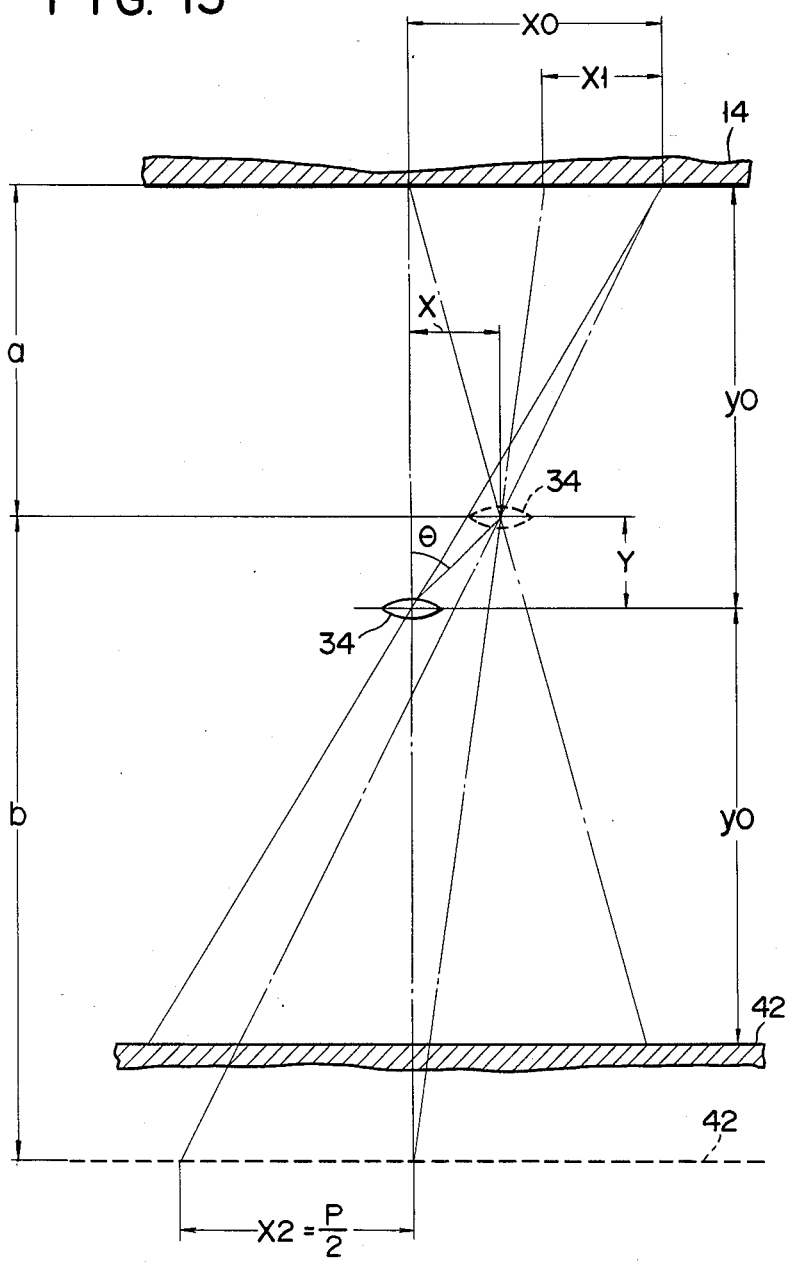
FIG. 13 is a schematic view for explaining the relationship between movement of a lens and an image formed on the photosensitive drum.

More specifically, the distance of movement of lens block 34 can be calculated as follows:

As shown in FIG. 13, when the distance from the central portion of document table 14 to one end portion of stationary scale 18 is given by $X_0$; the length from the center of sheet P to one of its end portions is expressed by $X2$ $(=P/2-\delta)$; the distance of movement of lens block 34 in the y direction, corresponding to a set magnification factor is given by Y, and that in the x direction factor is given by X; the angle formed by a line connecting the center of lens block 34 at an equal magnification factor (indicated by solid lines) and the angle formed at a predetermined copying magnification factor (indicated by dotted lines), and the optical axis of lens block 34 (indicated by the solid lines) is given by $\theta$, and distances between lens block 8, and document table 14 and sheet P are given by a and b; the relationship is expressed by:

$$X=Y\tan\theta$$

$$(X_0+X_2)/(a+b)=(X_2+Y\tan\theta)/b$$

Focal length f of lens block 34 is expressed by:

$$1/a+1/b=1/f$$

Magnification factor K is expressed by:

$$K=b/a$$

When the above relation is solved for X, the relationship can be expressed by:

$$X=F(K, X0, f, P) \quad (1)$$

Since $X_0$ and f are constants determined by a copying machine, relation (1) can be modified as:

$$X=F(K, P)$$

More specifically, moving distance X of lens block 34 along stationary scale 16 is determined by the magnification factor and the sheet size. If the magnification factor and the sheet size are set, distances of movement X and Y of lens block 34 can be obtained. As a method of moving lens block 34, a pulse number corresponding to X=F(K, P) is stored in a storage unit consisting of a ROM and the like. When magnification factor K and sheet size P are input, the stored pulse number is read out in accordance with the input data, and motor 252 is driven in accordance with the pulse numbers.

Figure 14:
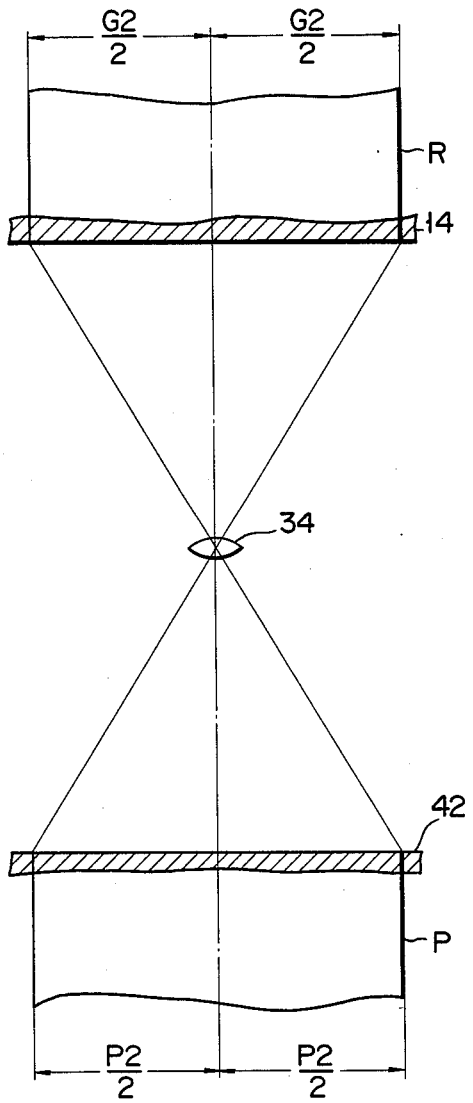
FIGS. 14 to 18 are views for explaining the operation states of the lens unit in accordance with various setting conditions.
Figure 15:
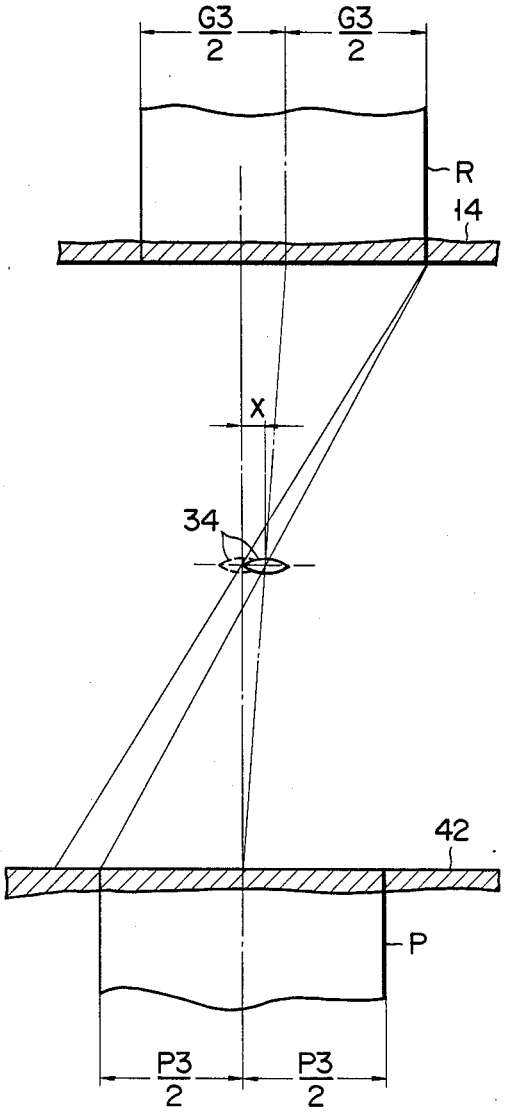

FIG. 14 shows the operating state of lens block 34 in accordance with the set position of a document, the copying magnification factor, and the sheet size. FIG. 14 illustrates a case wherein document R having width $G_2$ is placed with reference to its center and is copied on sheet P having width $P_2$, at an equal magnification factor. FIG. 15 illustrates a case wherein document R having width $G_3$ is placed with reference to one of its side portions and is copied, on sheet P having width $P_3$, at an equal magnification factor. In this case, lens block 34 is moved, from a reference position in FIG. 14 (indicated by a broken line), by distance X.

Figure 16:
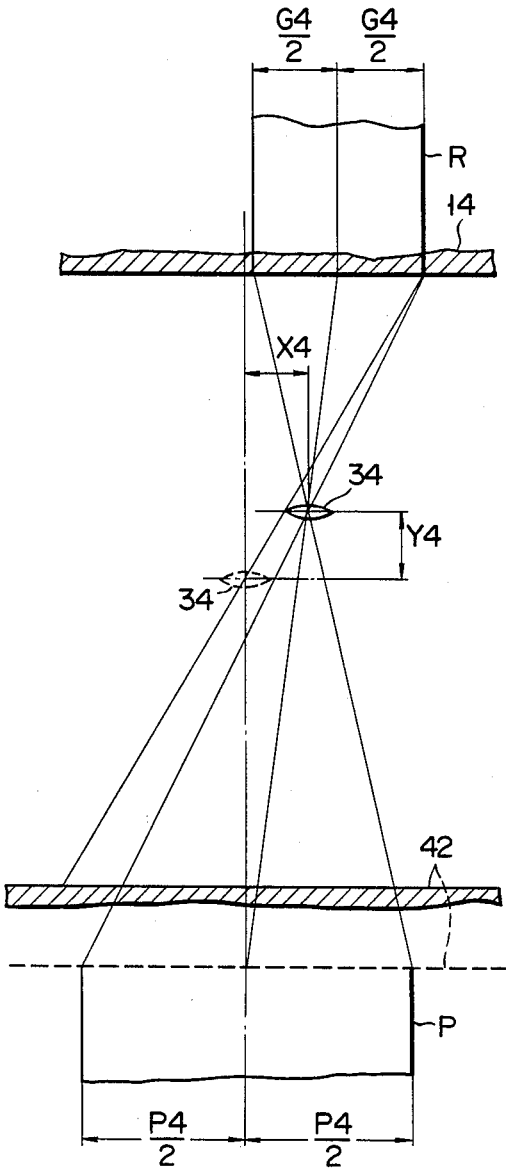

FIG. 16 illustrates a case wherein document R having width $G_4$ is placed with reference to one of its side portions and is copied, on sheet P having width $P_4$, to be enlarged. In this case, lens block 34 is moved from the reference position (indicated by the broken line), in the x and Y directions, by distances $X_4$ and $Y_4$, respectively.

Figure 17:
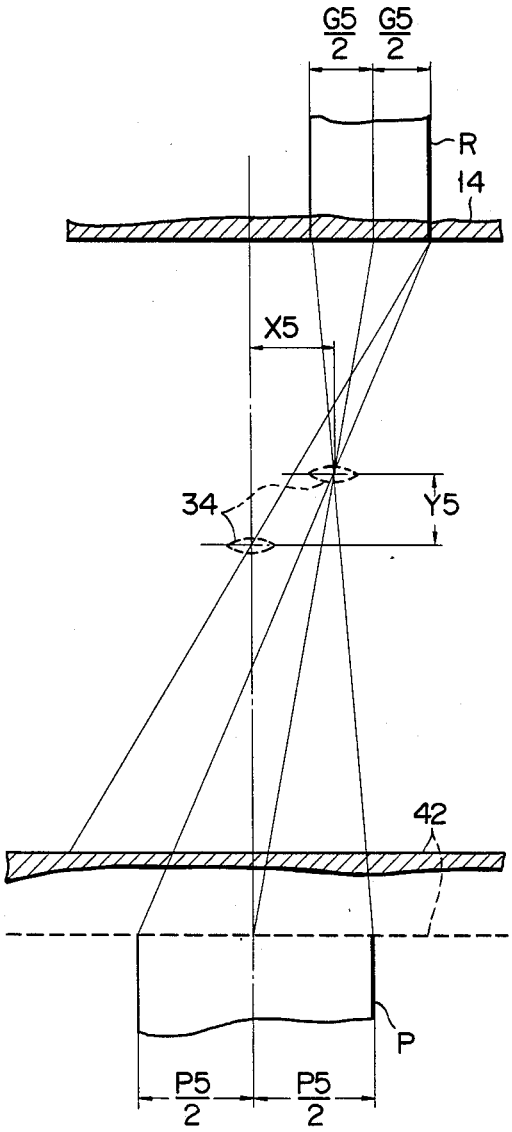

FIG. 17 illustrates a case wherein document R having width $G_5$ is placed with reference to one of its side portions and is copied, on sheet P having width $P_5$, to be enlarged. In this case, lens block 34 is moved from the reference position (indicated by the broken line), in the X and Y directions, by distances $X_5$ and $Y_5$, respectively.

Figure 18:
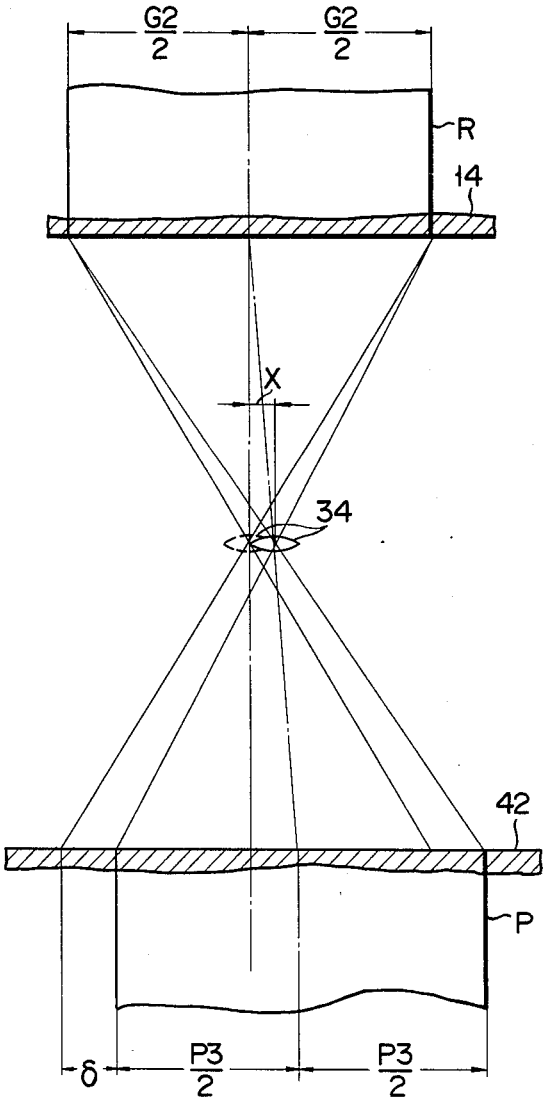

FIG. 18 illustrates a case wherein document R having width $G_2$ is placed with reference to its center and is copied, on sheet P having width $P_3$, at an equal magnification factor, by moving sheet P by distance $\delta$. In this case, lens block 34 is moved from the reference position (indicated by the broken line), by distance X.

Figure 19:
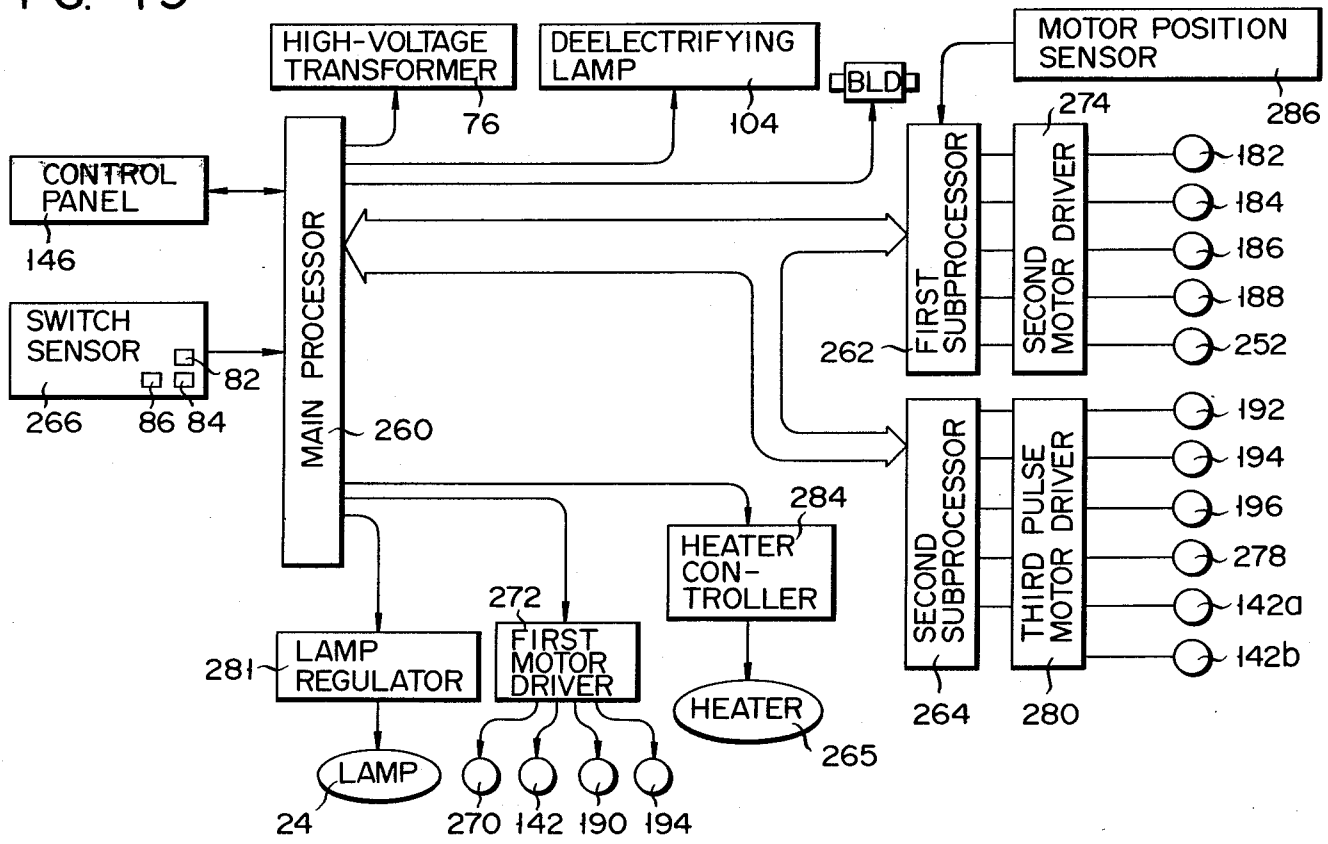
FIG. 19 is a schematic block diagram showing an entire control circuit of the copying machine.

A control circuit for electronic copying machine 10 will now be described in detail with reference to FIG. 19.

The control circuit comprises main processor 260 and first and second subprocessors 262 and 264. Main processor 260 detects inputs from input devices 266, such as control panel 146, various switches and sensors, for example, cassette size-detection switches 82, 84, and 86, and the like, and controls high-voltage transformer 268 for driving various chargers, deelectrifying lamp 104, a blade solenoid of cleaning device 52, heater 265 of fixing roller pair 94, exposure lamp 24, and the respective motors. Processor 260 performs a copying operation of document R, and controls motor 252 for moving lens block 34, thereby controlling the movement of a document image corresponding to the reference position of a placed document (to be described later).

Developing motor 190, fixing motor 194, first carriage motor 200, and toner motor 270 for supplying toner to developer 48 are controlled by processor 260 via first motor driver 272. Lens motor 182, mirror motor 184, scanning motor 186, shutter motor 188, and lens block motor 252 are controlled by first subprocessor 264 via second pulse motor driver 274. Drum motor 192, register roller motor 198, sheet-supply motor 196, and motor 278 for third scale 20 are controlled by second subprocessor 266 via third pulse motor driver 280. Exposure lamp 24 is controlled by main processor 260 via lamp regulator 281, and fixing heater 265 is controlled by main processor 260 via heater controller 284. Drive and stop commands for driving and stopping the respective motors are sent from main processor 260 to second subprocessors 262 and 264, and status signals indicating the drive and stop states of the respective motors are sent from subprocessors 262 and 264 to main processor 260. First subprocessor 262 receives position data from position sensor 286 for detecting the initial positions of motors 182, 184, 186, 188, and 252.

Figure 20:
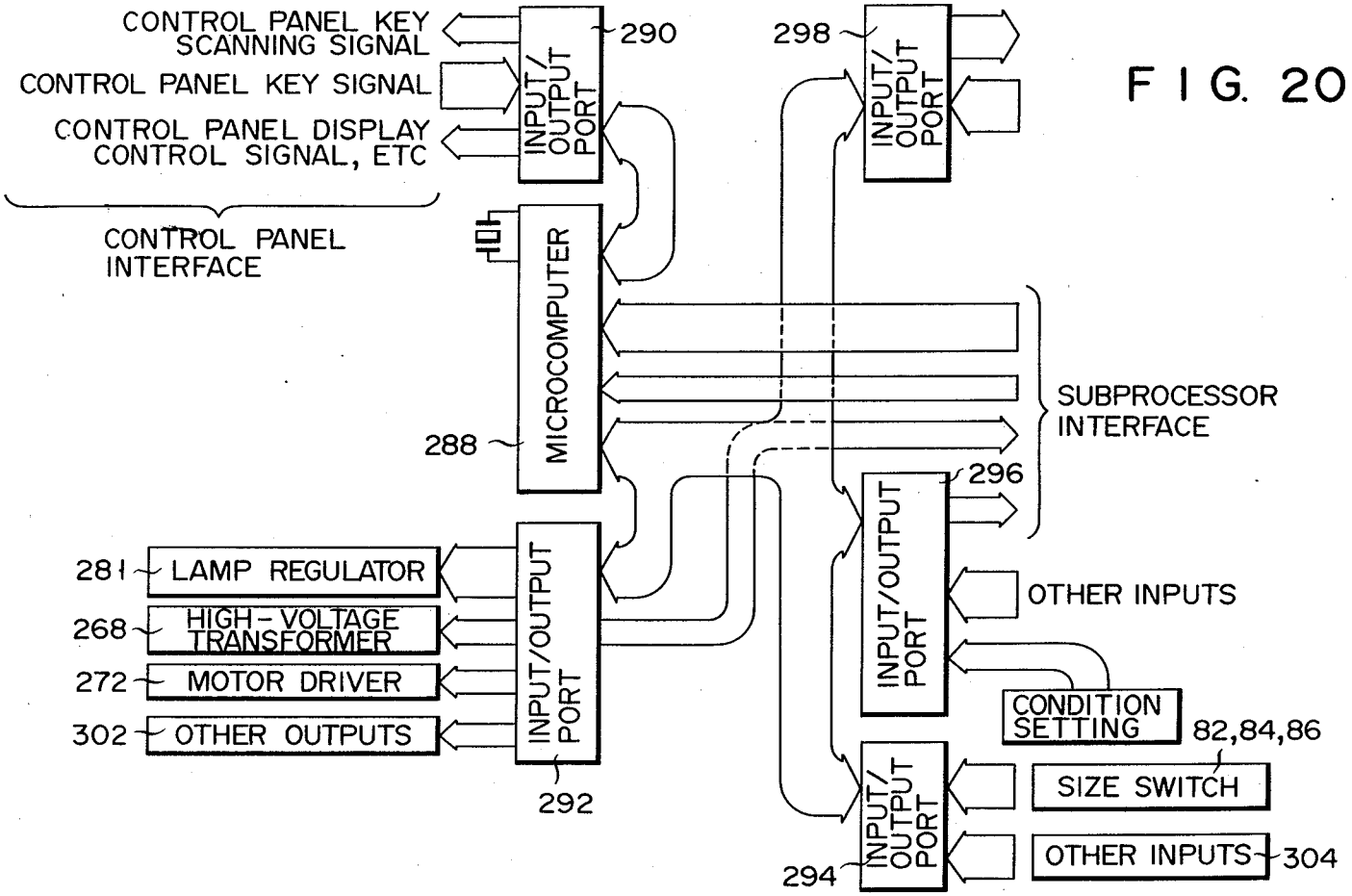
FIG. 20 is a block diagram of a main processor group shown in FIG. 19.

FIG. 20 shows the arrangement of main processor 260. Reference numeral 288 denotes a one-chip microcomputer which detects key inputs from control panel 146 and performs display control via first input/output (I/O) port 290. Microcomputer 288 is connected to second, third, fourth, and fifth I/O ports 292, 294, 296, and 298. Second I/O port 292 is connected to high-voltage transformer 268, motor driver 272, lamp regulator 281, and other outputs 302. Third I/O port 294 is connected to size switches 82, 84, and 86 for detecting sheet sizes, and other inputs 304. Fourth I/O port 296 is connected to control panel 184 and receives copying conditions therefrom. Note that fifth I/O port 298 is used for connecting optional devices.

Figure 21:
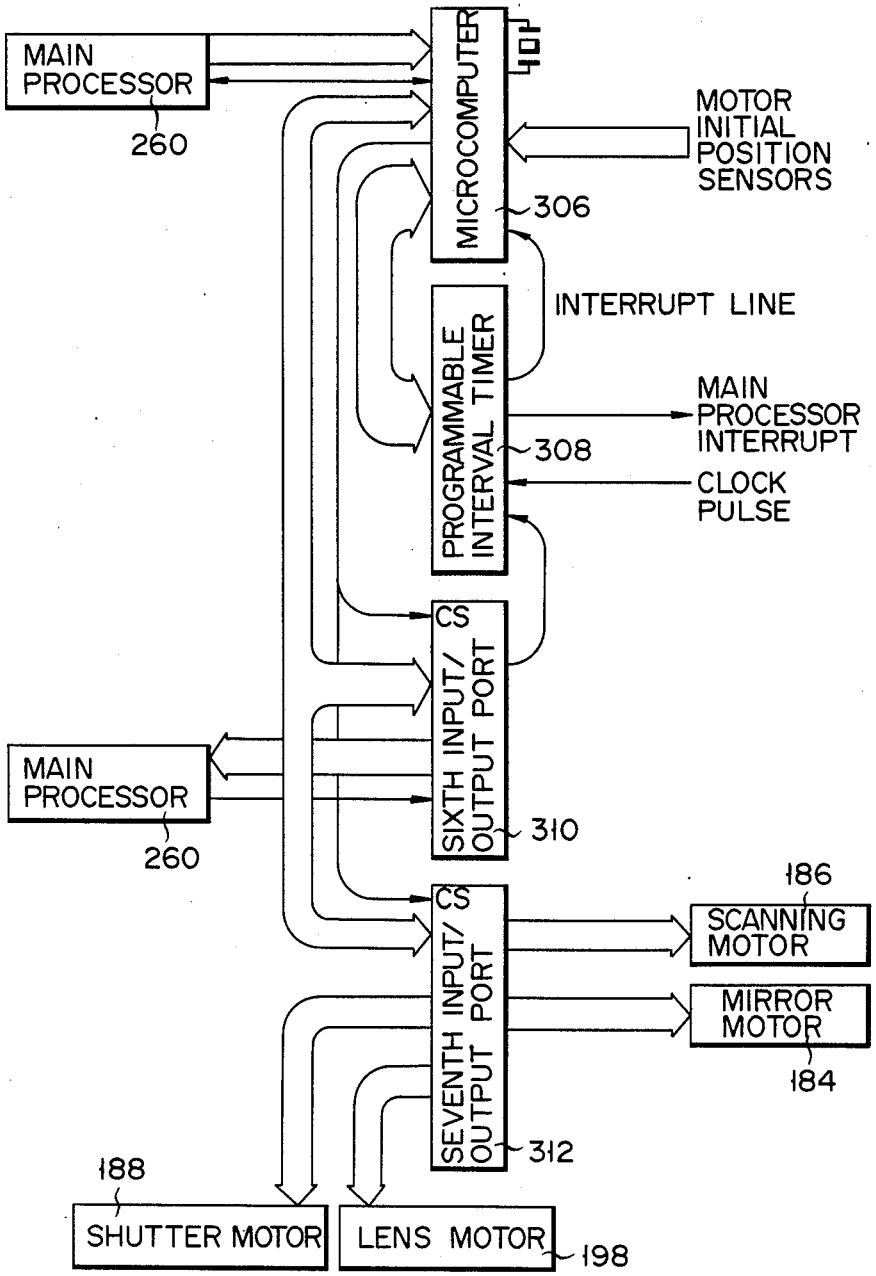
FIG. 21 is a block diagram of a first subprocessor group shown in FIG. 19.

FIG. 21 shows the arrangement of first subprocessor 262. Reference numeral 306 denotes a microcomputer, which is connected to main processor 260. Reference numeral 308 denotes a programmable interval timer for controlling switching intervals of pulse motors. A preset value is set in timer 308 by microcomputer 306, and timer 308 counts in accordance with the preset value. When timer 308 counts out, it outputs an end pulse to an interrupt line of microcomputer 306. In addition, a reference clock pulse is input to timer 308. Microcomputer 306 receives position data from position sensor 286 and is connected to sixth and seventh I/O ports 310 and 312. Seventh I/O port 312 is connected to motor driver 374, lens motor 182, mirror motor 184, scanning motor 186, shutter motor 188, and lens block motor 252. Note that sixth I/O port 310 is used, for example, when status signals of the respective pulse motors are sent to main processor 260.

Figure 22:
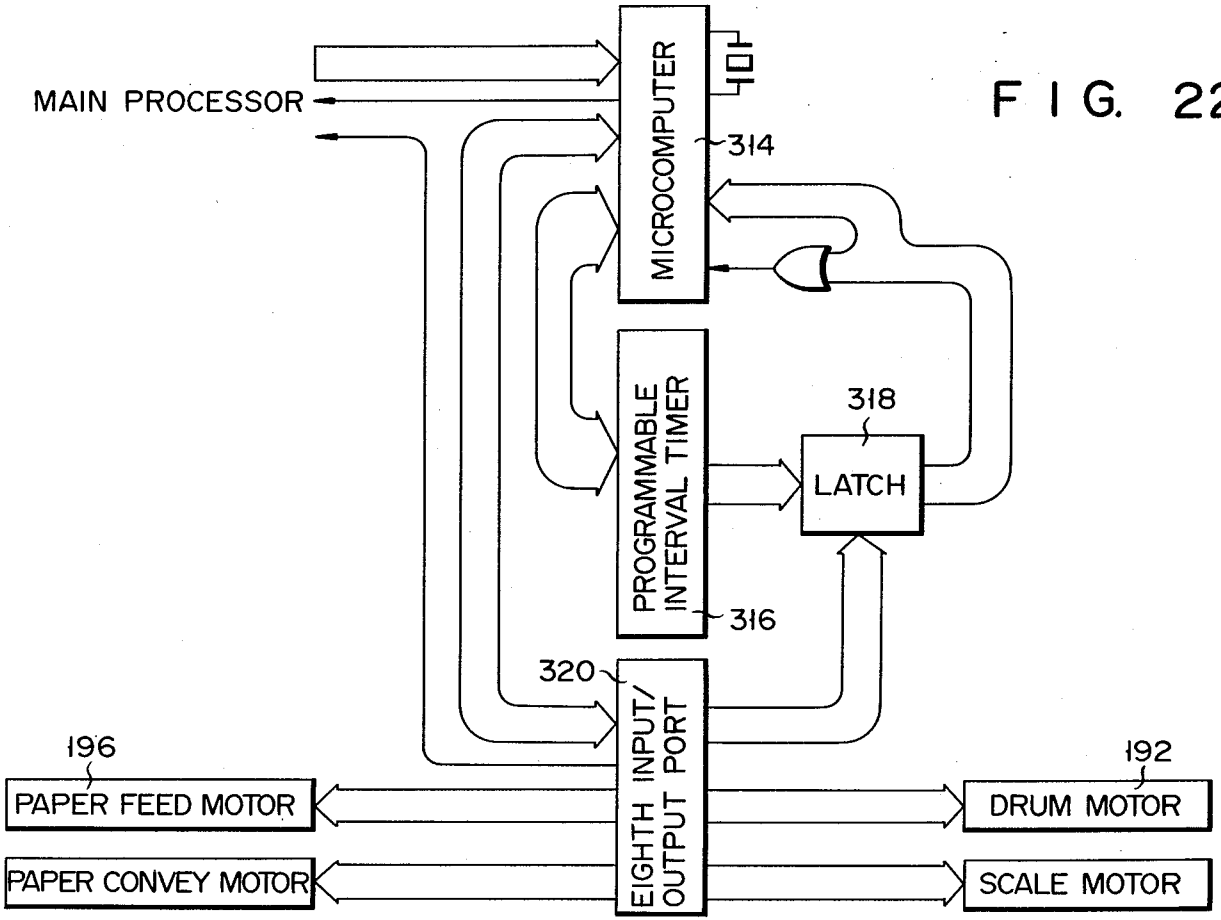
FIG. 22 is a block diagram of a second subprocessor group shown in FIG. 19.

FIG. 22 shows the arrangement of second subprocessor 264. Reference numeral 314 denotes a microcomputer which is connected to main processor 260. Reference numeral 316 denotes a programmable interval timer. A preset value is set in timer 316 by microcomputer 314, and timer 316 counts in accordance with the preset value. When timer 316 counts out, it supplies an end pulse which is latched by latch circuit 318. The output from latch circuit 318 is supplied to the interrupt line and an I/O port input line of microcomputer 314. Microcomputer 314 is connected to eighth I/O port 320, which is connected to drum motor 192, sheet-supply motor 196, register roller motor 198, and scale motor 278, via second pulse motor driver 274.

FIG. 23 shows a control circuit of the pulse motors. Seventh and eighth I/O ports 312 and 320 are connected to second and third pulse motor drivers 274 and 280, which are connected to windings A B, $\overline{A}$, and $\overline{B}$ of respective pulse motors 182, 184, 186, 188, 192, 196, 198, 278, and 252.

FIG. 24 shows a method for controlling the speed of the pulse motors. Upper graph (F) shows a speed curve of the pulse motor, and lower graph (G) shows phase-switching interval $t_x$. As can be seen from graph (G) in FIG. 24, phase-switching interval $t_x$ is long at the beginning, is gradually shortened, becomes constant, and is gradually prolonged, and the motor is then stopped. More specifically, this graph shows through-up and through-down, and reveals that the pulse motor rises from a selfenergization range, is used in a high-speed range, and the motor speed then falls. Reference numerals $t_1$, $t_2$, . . . , tx denote switching time intervals.

The operation of the control circuit will now be described with reference to FIGS. 25 to 28.

Figure 25:
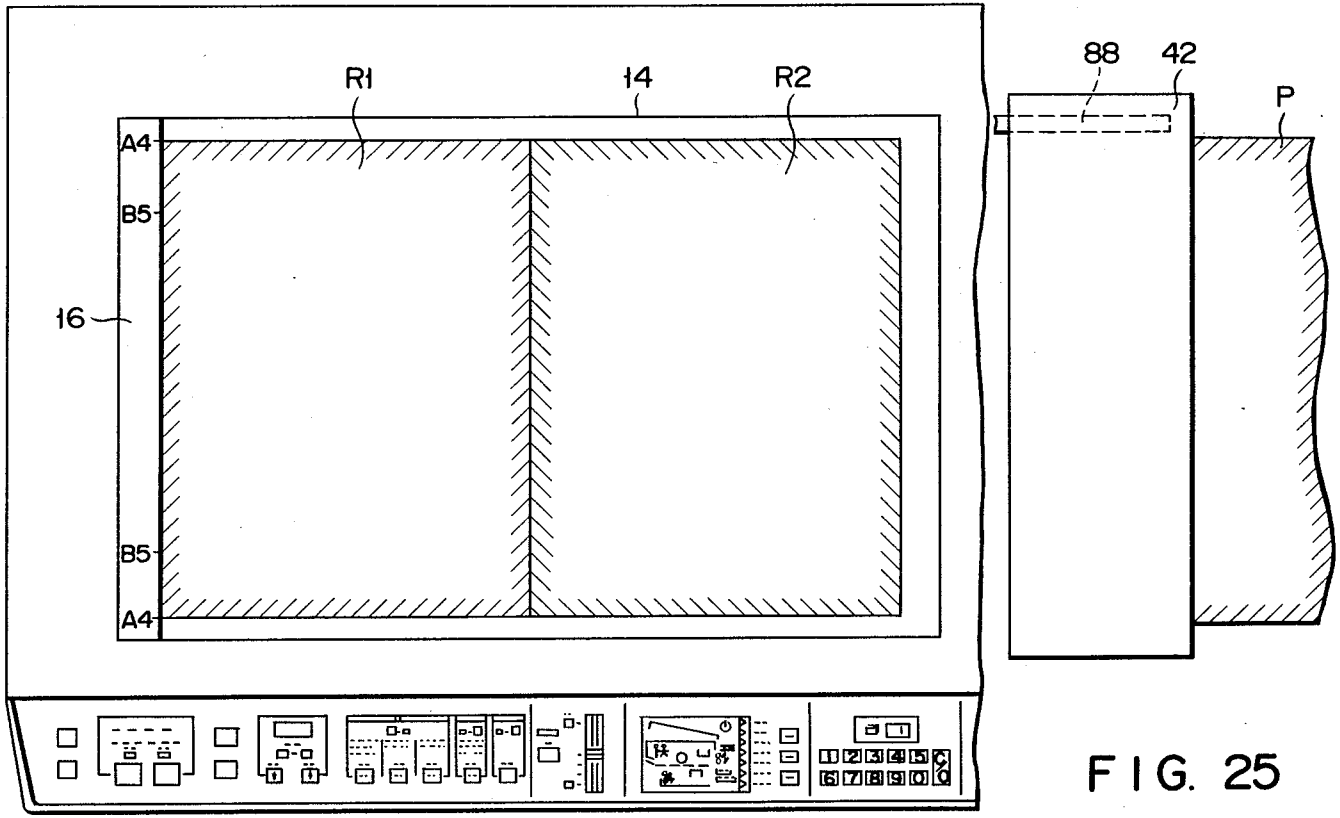
FIGS. 25 to 28 are schematic views for explaining the positional relationship among a document, a sheet, the photosensitive drum, and a peel-off tape.
Figure 26:
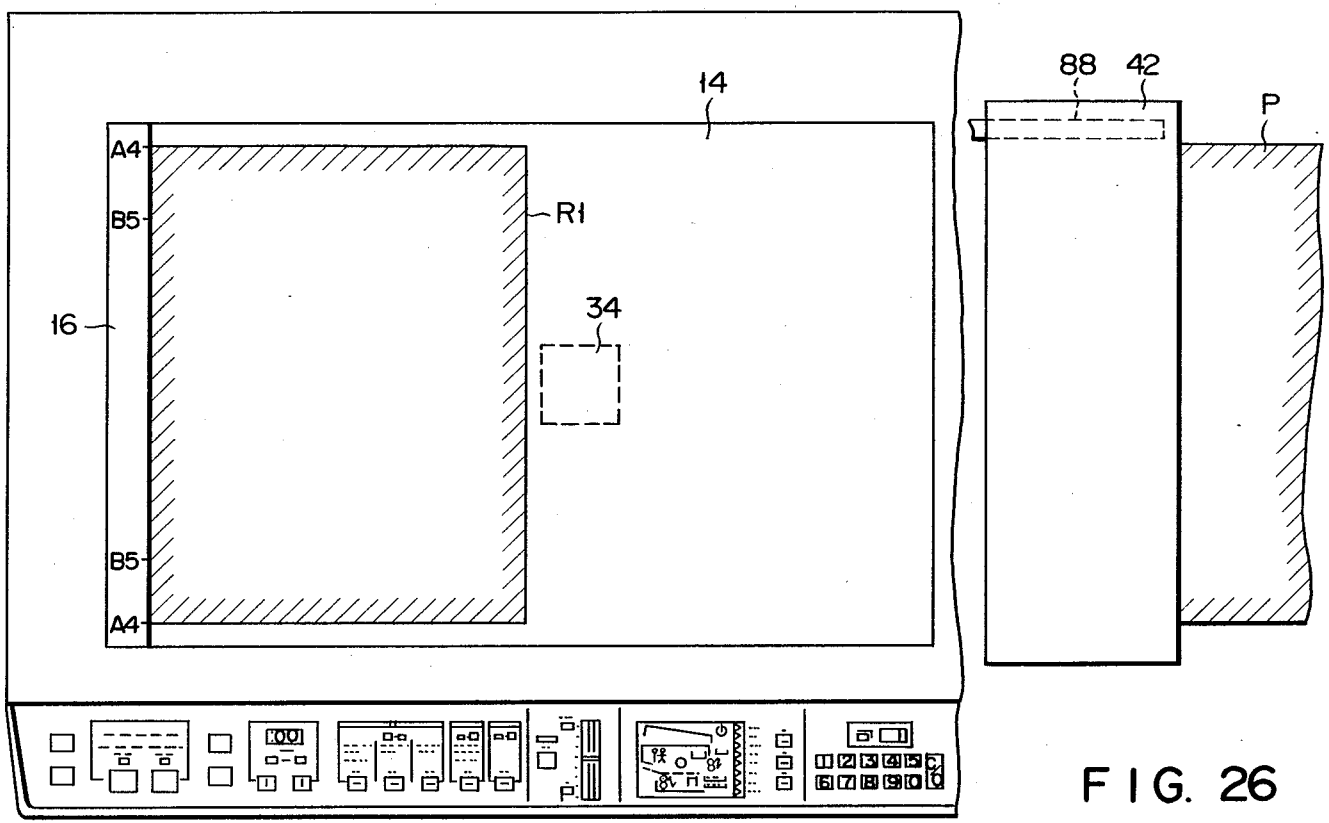

As is shown in FIG. 25, an operator places documents $R_1$ and $R_2$, for example, and depresses double-side copy key 168 (FIG. 7) and copy key 148. Main processor 260 detects a double-side copy command for two documents, and outputs the detection result to microcomputer 314. Microcomputer 314 drives scanning motor 186, to move carriages 200 and 202. At this time, exposure lamp 24 is illuminated by main processor 260. As is shown in FIG. 2, light from exposure lamp 24 is radiated onto document R1. Light reflected by document R1 is guided to mirrors 36 and 38 via lens block 34 and is reflected toward drum 42. As a result, an electrostatic latent image of document R1 is formed on drum 42, and is guided to developer 46 or 48 upon rotation of drum 42. For example, sheet P is picked up from cassette 56, and is fed between drum 42 and transfer device (charger) 50 via register roller pair 74. The image on drum 42 is transferred onto the surface of sheet P by transfer device 50 and, thereafter, sheet P is peeled off by deelectrifier or peeling charger 54. In this case, as is shown in FIG. 25, the edges of document R and sheet P are located on substantially the same line, and peel-off tape 88 is located outside sheet P, in view of the line. Therefore, sheet P and tape 88 are not engaged with each other, and a copying operation for the entire surface of document R1 can be performed on the surface of sheet P.

After image transfer, sheet P is conveyed to fixing roller 94 by way of conveyor belt 90, to fix the image transferred thereon. Sheet P is then fed to re-feed unit 98 via feed roller pair 98 and selector guide 100. In this manner, the image on document R1 is transferred to the surface of sheet P. In re-feed unit 98, sheet P is fed to stacking tray 108 via roller pairs 110, 112, and 114. More specifically, sheet P is fed to and stacked in stacking tray 108, as is shown in FIG. 5. Main processor 260 detects that a sheet is stacked in tray 108, and outputs the detection result to microcomputer 314. Microcomputer 314 drives motor 142 in accordance with the detection signal, thereby driving second side plate 138. Sheet P is moved to the first side plate 136 side by distance $(\delta_1+\delta_2)$, as is shown in FIG. 5. Thereafter, side plate 138 is returned to its original position upon operation of motor 142. In this manner, sheet P is picked up by pickup roller 116, as is shown in FIG. 6, and is conveyed to control gate 120 by separating roller pair 118. After sheet P is conveyed to control gate 120, it is guided to reverse unit 126 via conveyor roller pair 124. When sheet P is stored in reverse unit 126, control gate 120 is pivoted in the direction of arrow T, as is shown in FIG. 2, so that sheet P is guided to register roller pair 74 via conveyor roller pair 122 and sheet guide path 130. In this case, sheet P is reversed, and the non-image side (back surface) thereof faces drum 42.

Microcomputer 314 drives lens motor 182, to move lens block 34 by movement distance X corresponding to movement distance $\delta_1$ of sheet P, as shown in FIG. 18, so that an image to be formed on drum 42 is moved by distance $\delta_1$ (FIG. 5). Microcomputer 314 then drives scanning motor 186, to move first and second carriages 200 and 202 slightly backward and then to move them forward. In this case, light from exposure lamp 24 is radiated on document $R_2$. Light reflected by document $R_2$ is guided to mirrors 36, 38, and 40 via mirrors 26, 28, and 30 and lens block 34, and is then reflected by mirror 40 toward drum 42. A latent image of document $R_2$ is formed on drum 42, and is fed to developer 46 or 48, to be developed upon rotation of drum 42. At this time, sheet P from reverse unit 126 is fed between drum 42 and transfer device 50 via register roller pair 74. The image on drum 42 is transferred onto the back surface of sheet P by transfer device 50. After the transfer operation, sheet P is forcibly and reliably peeled off drum 42 by means of tape 88.

Figure 28:
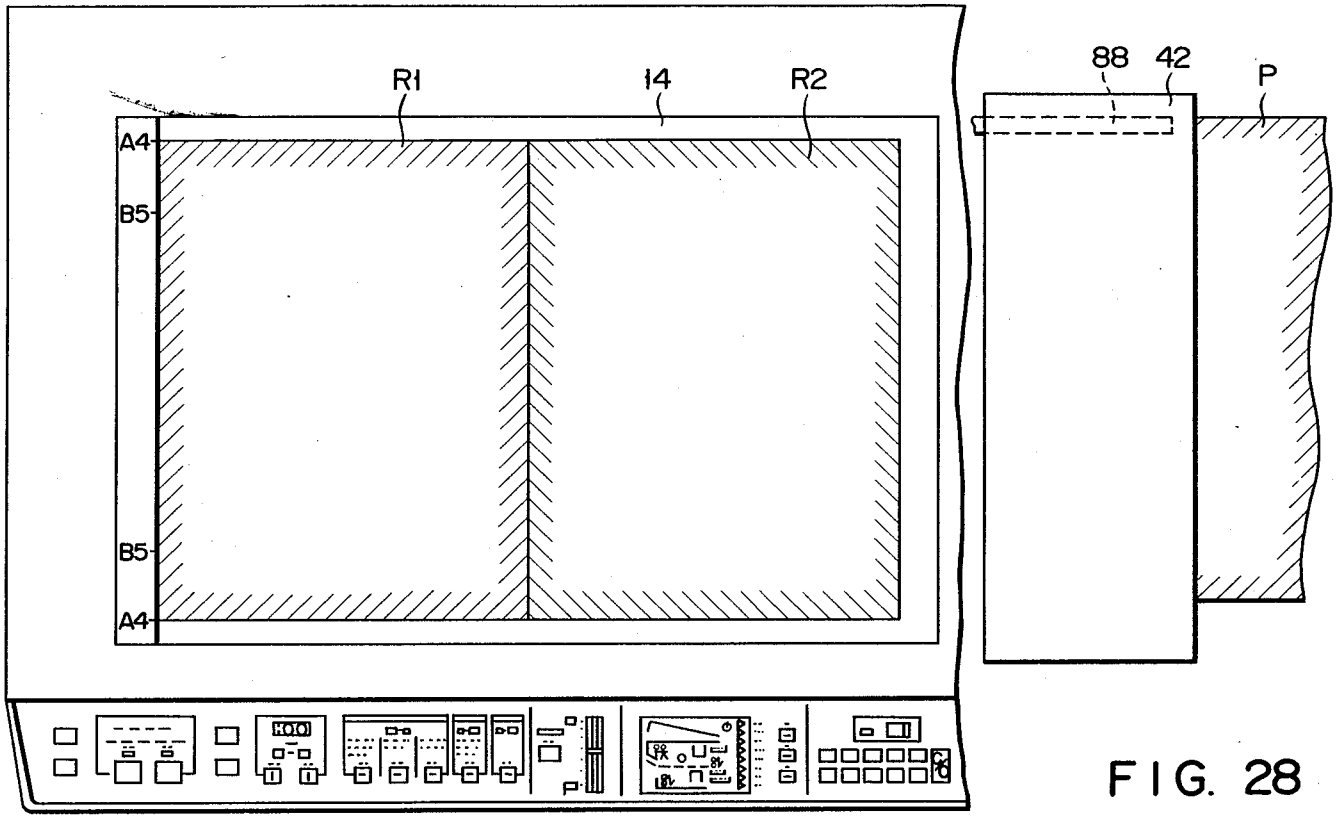

In this case, since sheet P is moved widthwise by distance $\delta_1$ (FIG. 5) in tray 108, as described previously, tape 88 is located inside the edge portion of sheet P, as is shown in FIG. 28. More specifically, the widthwise position of sheet P is adjusted in tray 108, so that its edge portion is engaged with tape 88. For this reason, the image of document R2 is not to be formed on the portion of sheet P corresponding to tape 88. In this case, since the edge of document R2 is located inside tape 88, the image of document R2 is no longer erased by tape 88.

After the double-side image transfer operation, sheet P is fed to fixing roller 94 by conveyor belt 90, to fix the image thereon, and is then ejected into tray 92 outside housing 12 via roller pair 96, selector guide 100, and exhaust roller pair 102.

With this embodiment, during a double-side copying operation, when the copying operation is performed on the front surface of sheet P, the toner image on drum 42 is transferred onto sheet P and, thereafter, sheet P is peeled off drum 42 only by deelectrifier 54. More specifically, sheet P is peeled off drum 42 by utilizing the sheet's inherent stiffness. When the copying operation for the second time is made, this time on the back surface of sheet P, after the toner image is transferred onto sheet P, the sheet is peeled off drum 42 by means of peel-off tape 88. Once the toner image is transferred onto sheet P and is fixed thereon, the stiffness of the sheet P is weakened and the sheet becomes curled. Therefore, sheet P can no longer be peeled off drum 42 simply by deelectrifying between the sheet and drum 42. According to the present invention, after the second transfer operation, sheet P is mechanically peeled off by means of tape 88.

In this case, during the first copying operation (for the front surface), the entire surface (100%) of document $R_1$ is copied. However, during the second copying operation, the portion excluding the region corresponding to tape 88 is copied.

In this embodiment, lens block 34 is arranged to be movable in the widthwise direction of sheet P (in the x directions shown in FIG. 27). Therefore, the image of the document can always be copied on the central portion of sheet P.

Figure 29:
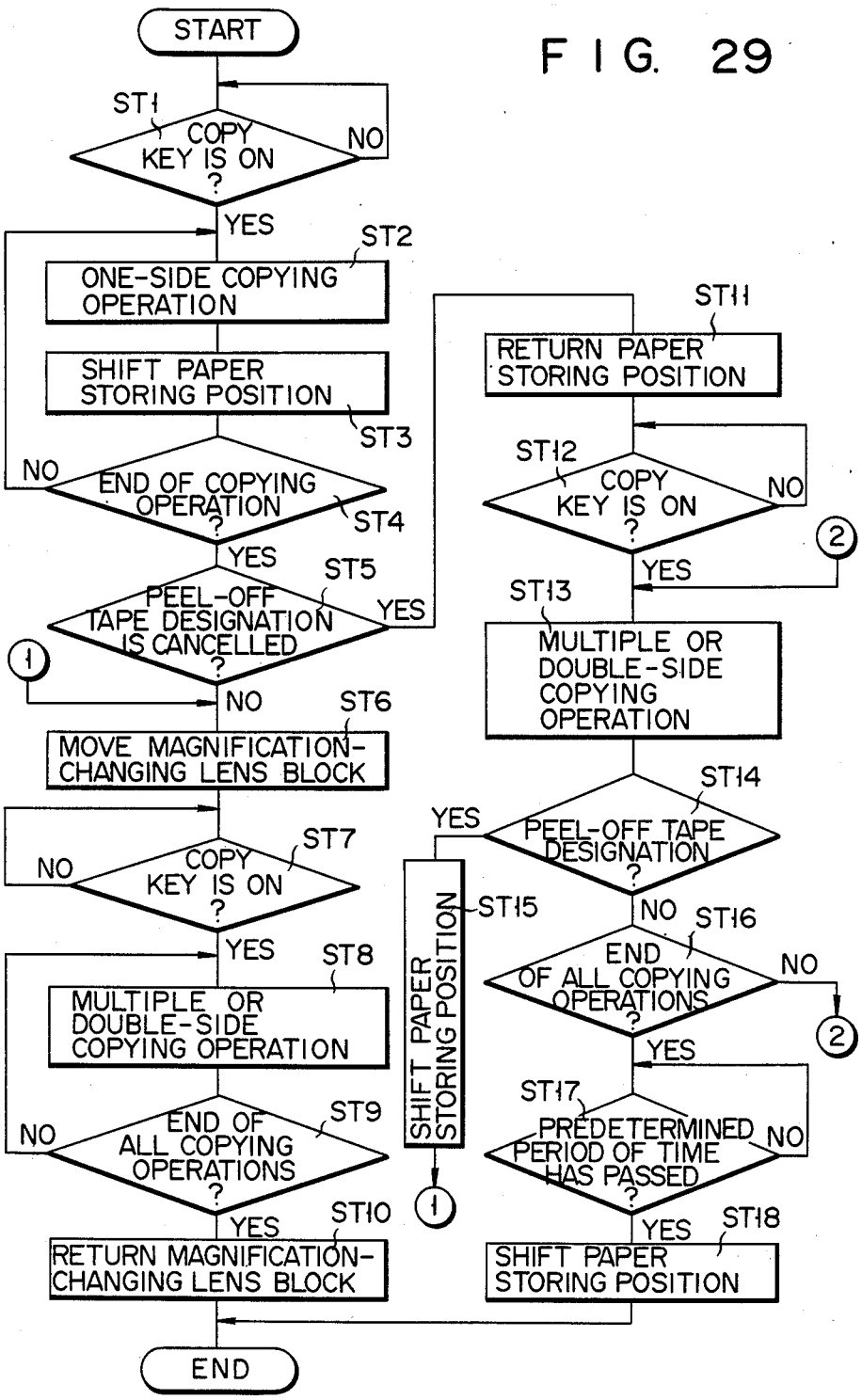
FIG. 29 is a flow chart for explaining a double-side copying operation.

The document-copying operation of this embodiment will now be described with reference to FIG. 29. In step $ST_1$, it is checked whether copy key 148 has been operated. If the copy key has been operated, the image of document R is copied on sheet P by means of the same copying operation as described above, and copied sheet P is fed to re-feed unit 98. When sheet P is fed to unit 98, second side plate 381 of stacking tray 108 is moved, in step $ST_3$. More specifically, as is shown in FIG. 5, the distance between second and first side plates 138 and 136 is normally set to maximum distance Wmax. When sheet P is fed to tray 108, gap $\delta_1$ is formed between sheet P and side plate 138, and gap $\delta_2$ is formed between side plate 136 and sheet P. When sheet P is fed to tray 108, second subprocessor 264 is operated to rotate motor **142*b* via third pulse motor driver 280, thereby moving second side plate 138 toward first side plate 136 by distance $(\delta_1+\delta_2)$. Therefore, when sheet P is fed to tray 108, it is moved toward first side plate 136, as is shown in FIG. 5. Thereafter, motor 142*b* is rotated in the reverse direction, thereby returning second side plate 138 to a position indicated by the solid line in FIG. 4. Thereafter, in step $ST_4$, the copying number set by control panel 146 is detected, and the above copying operation is repeated the set number of times. If it is detected in step $ST_4$ that the set number of copying operations has been completed, second side plate 138 is stopped at a position separated from first side plate 136 by distance Wp, as is indicated by the solid line in FIG. 5. Distance Wp substantially coincides with the width of sheet P. Thereafter, in step $ST_5$, it is checked whether peel-off tape cancel key 176 has been operated. If it is determined that key 176 has not been operated, lens block motor 252 is driven via first subprocessor 262 and second motor driver 274, thereby moving lens block 34 along first scale 16, by distance X or $\delta_2/2$, as is shown in FIG. 27. Therefore, the position of the document image formed on drum 42** coincides with that of sheet P, moved by distance $\delta 2$.

Thereafter, when another document is placed on document table 14 and copy key 148 is again operated, this is detected in step $ST_7$, and a multiple-copying or double-side copying operation is performed, in step $ST_8$. More specifically, pickup roller 116 is driven to pick up sheet P stacked in tray 108, as is shown in FIG. 6. Picked-up sheet P is conveyed to control gate 120 one by one, by separating roller pair 118, and is fed directly to drum 42 or is supplied thereto after it is reversed by reverse unit 126. First carriage 200 and drum 42 are driven, and the image of the document placed on table 14 is formed on drum 42, to coincide with the position of sheet P. The image formed on drum 42 is transferred onto sheet P, which is then peeled off by means of tape 88. For this reason, in the multiple-copying or double-side copying operation, an image is not formed on the region corresponding to the width of tape 88. Multiple-copied or double-side copied sheet P is ejected by means of fixing roller pair 94. Thereafter, in step $ST_9$, it is checked whether all the sheets in tray 108 have been copied. If NO in step $ST_9$, the flow returns to step $ST_8$, and the above operation is repeated. If YES in step $ST_9$, the flow advances to step $ST_{10}$, lens block 34 is returned to an equal-magnificaiton position, and all the processing is completed.

If it is determined in step $ST_5$ that key 176 has been operated, the flow advances to step $ST_{11}$. In step $ST_{11}$, motors **142*a* and 142*b* are driven via second subprocessor 164 and third motor driver 280, and first and second side plates 136 and 138 are moved by distance $\delta_1$, as is shown in FIG. 5. For this reason, sheets P which have been stacked to be shifted toward side plate 136, by distance $\delta_1$, are again moved to a position which does not correspond to tape 88. In this state, when another document R is placed on table 14 and copy key 148 is operated, its operation is detected in step $ST_{12}$, and the flow advances to step $ST_{13}$. In step $ST_{13}$, the multiple-copying or double-side copying operation, as in step $ST_8$, is performed by using only deelectrifier 54. Paper jamming may occur during the multiple-copying or double-side copying operation if only deelectrifier 54 is used; consequently, peel-off tape key 174 may have to be operated. In step $ST_{14}$, therefore it is checked whether key 174 has been operated. If YES in step $ST_{14}$, the flow advances to step $ST_{15}$. In step $ST_{15}$, motors 278 and 142 are driven to move first and second side plates 136 and 138 to the positions indicated by the solid lines in FIG. 5, whereupon the sheet can be peeled off, by using tape 88. Thereafter, the flow returns to step ST6, and after lens block 34 is moved, the above-mentioned multiple-copying or double-side copying operation is performed. However, if NO in step $ST_{14}$, it is checked in step $ST_{16}$ if the copying operation for all the sheets in tray 108** is completed. As a result, if NO in step $ST_{15}$, the flow returns to step $ST_{13}$, and the above copying operation is repeated.

If it is determined in step $ST_{16}$ that all the copying operations have been completed, the flow advances to step $ST_{17}$. In step $ST_{17}$, it is checked whether a predetermined period of time, for example, 20 to 30 seconds, has passed. If YES in step $ST_{17}$, motor 141 is driven and first side plate 136 is returned to the position shown in FIG. 5, so that a peel-off operation by means of tape 88 is forcibly performed. Then, all the processing is completed.

With this embodiment, a sheet is peeled off drum 42, using only deelectrifier 54 for the first copying operation, when in a normal copying mode, or when in a multiple-copying or double-side copying mode. During the second copying operation in the multiple-copying or double-side copying mode, the peel-off operation, with or without using tape 88, can be selected in accordance with, the operation of keys 174 and 176 of control panel 146. Therefore, a peel-off means can be selected in accordance with the type or condition of the sheet. If a sheet can be peeled off without using tape 88, then it can be peeled off, using only deelectrifier 54 and no non-image portion is formed.

When peel-off tape 88 is used or when its use is canceled, first and second side plates 136 and 138, in tray 108, are moved. Since the arrangement therefor is very simple, the entire apparatus will not be bulky, and alignment of the sheets supplied to tray 108 can be performed at the same time. During repetitive sheet-feeding operations, paper jamming can be eliminated, thus providing a practical advantage.

During the second copying operation in the multiple-copying or double-side copying mode, lens block 34 is moved by a distance half the moving distance of the sheet, thereby changing the position of the document image formed on drum 42. Therefore, the portion of an image corresponding to tape 88 is not formed, and the area of a non-image portion can be minimized.

When the multiple-copying or double-side copying operation is performed without using tape 88, after the lapse of a predetermined period of time, first side plate 136 is automatically returned. Thus, when the multiple-copying or double-side copying operation is again performed, the peel-off operation using tape 88 is performed. Therefore, even if a user selects multiple-copying or double-side copying mode without taking special care, the sheet is forcibly peeled off, using tape 88, during the second copying operation, thus preventing paper jamming.

In the above embodiment, when the multiple-copying or double-side copying operation is performed, two different documents are sequentially set at scale 16. However, as is shown in FIG. 25, two different documents $R_1$ and $R_2$ can be placed parallel to each other. Upon first depression of copy key 148, document $R_1$ is first scanned by first carriage 200, a set number of times and thereafter, document $R_2$ is scanned to automatically perform the multiple-copying or double-side copying operation. With this arrangement, the same effect as in the above embodiment can be obtained.

The present invention is not limited to the above embodiment, and various changes and modifications may be made within the spirit and scope of the invention.

For example, in the above embodiment, the double-side copying mode for forming images on both surfaces of a sheet has been described. The same effect can the obtained in the multiple-copying mode in which two different colors are overlaid on the surface of a sheet, to form a multicolor image.

Figure 30:
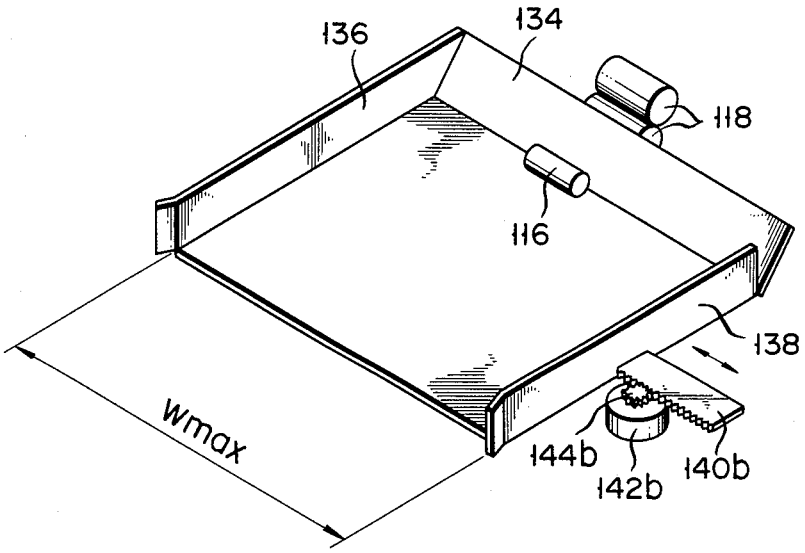
FIG. 30 is a perspective view showing a modification of a stacking tray.

In the above embodiment, in stacking tray 108, the motors and racks are coupled to both first and second side plates 136 and 138, to be movable with respect to the bottom plate. For example, as is shown in FIG. 30, one side plate, for example, first side plate 136 can be fixed, and only second side plate 138 can be movably arranged to obtain the same effect.

In the above embodiment, during the second copying operation, the peel-off tape is used to peel a sheet off drum 42. However, the peel-off tape can be located to be engaged with a sheet during the first copying operation.

What is claimed is:

1. An image forming apparatus for forming an image on a document, on a sheet, comprising:

an image carrier;

image forming means for forming an electrostatic image corresponding to an image on a document, on the image carrier;

transfer means which causes the sheet to be in contact with said image carrier, to transfer the latent image formed on said image carrier onto the sheet;

first peel-off means for electrically peeling the sheet off said image carrier, after the transfer operation;

second peel-off means which is engaged with the sheet to mechanically peel the sheet off said image carrier, after the transfer operation; and sheet position-control means for selectively moving the sheet between a first position at which the sheet is engaged with said second peel-off means and a second position at which the sheet is not engaged with said second peel-off means.

2. An apparatus according to claim 1, wherein said position-control means comprises a stacking tray, and a pair of side plates which are movable, in order to control the position of the sheet stacked in said stacking tray.

3. An apparatus according to claim 1, wherein each of said pair of side plates has a rack, a pinion meshed with said rack, a motor for driving said pinion, thereby regulating the positions of said side plates of said stacking tray by driving said motor.

4. An apparatus according to claim 1, wherein said position-control means is arranged in a re-feed unit for re-feeding a sheet, after a first copying operation, toward said image carrier, to perform a second copying operation.

5. An apparatus according to claim 4, wherein said re-feed unit comprises a selector guide for selectively guiding the sheet to a tray for receiving a sheet after the first copying operation, and also comprises said position-control means.

6. An apparatus according to claim 5, wherein said re-feed unit comprises a reverse unit for conveying the sheet after the toner image has been transferred, to face its surface to said image carrier, and for reversing the sheet, in order to perform a multiple copying operation, and conveys the sheet to face its back surface to said image carrier, when in a double-side copying mode, and conveys the sheet to face its front surface to said image carrier by means of said reverse unit, when in a multiple-coping mode.

7. An apparatus according to claim 6, wherein said first peel-off means has a deelectrifier for removing the sheet electrostatically attached to said image carrier, by use of deelectrifying charges.

8. An apparatus according to claim 7, wherein said second peel-off means is a tape-like member.

9. An apparatus according to claim 8, wherein said second peel-off means comprises a Mylar member.

10. An apparatus according to claim 8, wherein said second peel-off member is arranged in said transfer means, to extend in the conveying direction of the sheet.

11. An apparatus according to claim 10, wherein said second peel-off member is arranged at a position corresponding to an edge portion of the sheet along the conveying direction thereof.

12. An apparatus according to claim 1, wherein said position-control means has a processor for setting the sheet at a position at which the sheet is not engaged with said second peel-off means if a command for selecting the position of the sheet is not supplied for a predetermined period of time.

13. An apparatus according to claim 1, wherein image forming means comprises exposure means for radiating light onto the document, to expose it.

14. An apparatus according to claim 13, wherein said exposure means has a lens block which is movable in a direction perpendicular to the conveying direction of the sheet, and which moves said lens block in accordance with the position of the sheet moved by said position-control means, to form a latent image on said image carrier, so that the image of the document is formed at substantially the center of the sheet.

15. An apparatus according to claim 14, wherein said lens block has a rack coupled thereto, and has a motor for driving a pinion meshed with said rack.

16. An image forming apparatus for forming an image of a document on a sheet, comprising:

an image carrier;

image forming means for forming an electrostatic image corresponding to an image on a document, on the image carrier;

transfer means, which causes the sheet to be in contact with said image carrier, for transferring the latent image formed on said image carrier onto the sheet;

first peel-off means for electrically peeling the sheet off said image carrier after a transfer operation;

second peel-off means which is engaged with the sheet to mechanically peel the sheet off said image carrier after a transfer operation; and re-feed means for feeding a sheet having a latent image transferred thereto toward the transfer means for an additional transfer of a latent image thereto so as to achieve at least one of a double-side copying mode and a multiple-copying mode, the sheet fed first to the transfer means and being peeled from the image carrier by the first peel-off means and the sheet fed subsequently to the transfer means and being peeled from the image carrier by the second peel-off means.

17. An apparatus according to claim 16, wherein said re-feed means includes a stacking tray, and a pair of side plate which are movable, in order to control the position of the sheet stacked in said stacking tray.

18. An apparatus according to claim 17, wherein each of said pair of side plates has a rack, a pinion meshed with said rack, a motor for driving said pinion, thereby regulating the positions of said side plates of said stacking tray by driving said motor.

19. An apparatus according to claim 16, wherein said re-feed means comprises a reverse unit for conveying the sheet after the latent image has been transferred, to face its surface to said image carrier, and for reversing the sheet, in order to perform a multiple copying operation, and conveys the sheet to face its back surface to said image carrier, when in a double-side copying mode, and conveys the sheet to face its front surface to said image carrier by means of said reverse unit, when in a multiple-copying mode.

20. An apparatus according to claim 16, wherein the first peel-off means has a deelectrifier for removing the sheet electrostatically attached to said image carrier, by use of deelectrifying charges.

21. An apparatus according to claim 16, wherein said second peel-off means is a tape-like member.

22. An apparatus according to claim 21, wherein said second peel-off means comprises a Mylar member.

23. An apparatus according to claim 21, wherein said second peel-off member is arranged in said transfer means, to extend in the conveying direction of the sheet.

24. An apparatus according to claim 23, wherein said second peel-off member is arranged at a position corresponding to an edge portion of the sheet along the conveying direction thereof.

25. An apparatus according to claim 16, wherein image forming means comprises exposure means for radiating light onto the document, to expose it.

26. An apparatus according to claim 25, wherein said exposure means has a lens block which is movable in a direction perpendicular to the conveying direction of the sheet, and which moves said lens block in accordance with the position of the sheet moved by said position-control means, to form a latent image on said image carrier, so that the image of the document is formed at substantially the center of the sheet.

27. An apparatus according to claim 26, wherein said lens block has a rack coupled thereto, and has a motor for driving a pinion meshed with said rack.

28. An image forming apparatus for forming an image on a document, on a sheet, comprising:

an image carrier;

image forming means for forming an electrostatic image corresponding to an image on a document, on the image carrier;

transfer means, which causes the sheet to be in contact with said image carrier, for transferring the latent image formed on said image carrier onto the sheet;

first peel-off means for electrically peeling the sheet off said image carrier, after a transfer operation;

second peel-off means which is engaged with the sheet to mechanically peel the sheet off said image carrier, after a transfer operation; and selecting means for selecting a first mode in which the sheet is peeled from the image carrier by said first peel-off means and a second mode in which the sheet is peeled from the image carrier by said second peel-off means.

29. An apparatus according to claim 28, which further comprises re-feed means for feeding a sheet having a latent image transferred thereto toward the transfer means for an additional transfer of a latent image thereto so as to achieve at least one of a double-side copying mode and a multiple-copying mode, and wherein the first peel-off means is used in said first mode for the first and subsequent peeling of the sheet, and the first peel-off means is used for only the first peeling of the sheet in said second mode with the second peel-off means being used for the subsequent peeling of the sheet.

30. An apparatus according to claim 28, wherein said selecting means comprises a processor for selecting the second mode in the absence of a mode selecting command for a predetermined time.

31. An apparatus according to claim 28, wherein said selecting means comprises sheet position control means for selectively moving the sheet to a first position at which the sheet is engaged with the second peel-off means and to a second position at which the sheet is not engaged with the second peel-off means.

32. An apparatus according to claim 29, wherein said re-feed means includes a stacking tray, and a pair of side plates which are movable, in order to control the position of the sheet stacked in said stacking tray.

33. An apparatus according to claim 32, wherein each of said pair of side plates has a rack, a pinion meshed with said rack, a motor for driving said pinion, thereby regulating the positions of said side plates of said stacking tray by driving said motor.

34. An apparatus according to claim 29, wherein said re-feed means comprises a reverse unit for conveying the sheet after the latent image has been transferred, to face its surface to said image carrier, and for reversing the sheet, in order to perform a multiple copying operation, and conveys the sheet to face its back surface to said image carrier, when in a double-side copying mode, and conveys the sheet to face its front surface to said image carrier by means of said reverse unit, when in a multiple-copying mode.

35. An apparatus according to claim 28, wherein said first peel-off means has a deelectrifier for removing the sheet electrostatically attached to said image carrier, by use of deelectrifying charges.

36. An apparatus according to claim 28, wherein said second peel-off means is a tape-like member.

37. An apparatus according to claim 36, wherein said second peel-off means comprises a Mylar member.

38. An apparatus according to claim 36, wherein said second peel-off member is arranged in said transfer means, to extend in the conveying direction of the sheet.

39. An apparatus according to claim 37, wherein said second peel-off member is arranged at a position corresponding to an edge portion of the sheet along the conveying direction thereof.

40. An apparatus according to claim 28, wherein image forming means comprises exposure means for radiating light onto the document, to expose it.

41. An apparatus according to claim 40, wherein said exposure means has a lens block which is movable in a direction perpendicular to the conveying direction of the sheet, and which moves said lens block in accordance with the position of the sheet moved by said position-control means, to form a latent image on said image carrier, so that the image of the document is formed at substantially the center of the sheet.

42. An apparatus according to claim 41, wherein said lens block has a rack coupled thereto, and has a motor for driving a pinion meshed with said rack.

* * * * *